US010597882B2

(12) United States Patent
Whittemore

(10) Patent No.: US 10,597,882 B2
(45) **Date of Patent: *Mar. 24, 2020**

(54) PARTITION MOUNT SYSTEM INCLUDING HEAD COUPLER WITH ADJUSTABLE HEAD LENGTH AND HEAD POSITION

(71) Applicant: Zipwall, LLC, Arlington, MA (US)

(72) Inventor: Jeffrey P. Whittemore, Arlington, MA (US)

(73) Assignee: Zipwall, LLC, Arlington, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/121,778

(22) Filed: Sep. 5, 2018

(65) Prior Publication Data

US 2019/0003193 A1 Jan. 3, 2019

Related U.S. Application Data

(63) Continuation of application No. 15/216,877, filed on Jul. 22, 2016, now Pat. No. 10,081,955.

(Continued)

(51) Int. Cl.
*E04G 25/00* (2006.01)
*E04G 21/24* (2006.01)

(Continued)

(52) U.S. Cl.
CPC ..... *E04G 25/00* (2013.01); *E04G 21/243* (2013.01); *E04G 21/30* (2013.01); *E04G 25/04* (2013.01);

(Continued)

(58) Field of Classification Search
CPC . E04G 21/243; E04G 2025/006; E04G 25/00; E04G 25/04

(Continued)

(56) References Cited

U.S. PATENT DOCUMENTS 827,000 A 7/1906 Dinsmore
1,177,274 A 3/1916 Robbins (Continued)

FOREIGN PATENT DOCUMENTS

CN 102513439 6/2012
DE 3918516 12/1990

(Continued)

OTHER PUBLICATIONS

Supplementary European Search Report dated Mar. 11, 2019 issued in corresponding European Application No. 16831109.

(Continued)

*Primary Examiner* — Johnnie A. Shablack
(74) *Attorney, Agent, or Firm* — Onello & Mello, LLP

(57) ABSTRACT

A coupler comprises a first channel having a first axis of extension in a first horizontal direction and a second channel having a second axis of extension in the first horizontal direction. The second axis of extension is parallel to and spaced apart from the first axis of extension in a second horizontal direction. The second axis of extension has a pitch angle relative to the first axis of extension in a vertical direction, the pitch angle being less than 180 degrees. The first and second channels each include head-mounting features, the head-mounting features constructed and arranged to retain an elongated head to the coupler while permitting movement of the elongated head relative to the coupler in the first horizontal direction.

19 Claims, 25 Drawing Sheets

Related U.S. Application Data

(60) Provisional application No. 62/196,598, filed on Jul. 24, 2015.

(51) Int. Cl.
*E04G 25/04* (2006.01)
*E04G 21/30* (2006.01)
*A47H 1/00* (2006.01)
*E04G 11/52* (2006.01)

(52) U.S. Cl.
CPC ..... *A47H 1/00* (2013.01); *E04G 11/52* (2013.01); *E04G 2021/248* (2013.01); *E04G 2025/006* (2013.01)

(58) Field of Classification Search
USPC ..... 248/200.1, 354.1; 160/368.1, 351, 354, 160/327; 403/331, 109.1, 90, 114
See application file for complete search history.

(56) References Cited

U.S. PATENT DOCUMENTS 1,766,324 A 6/1930 Berner
2,219,169 A 10/1940 Alter
2,232,194 A 2/1941 Zogby
2,474,158 A 9/1944 Neely
2,539,703 A 1/1951 Sato
2,816,769 A 12/1957 Noble
2,903,227 A 9/1959 de Kalb Key
2,942,829 A 6/1960 Stiffel
3,072,784 A 1/1963 Mann
3,090,826 A 5/1963 Cochran
3,118,363 A 1/1964 Burgess, Jr.
3,247,558 A 4/1966 Kaufman
3,328,966 A 4/1967 Creuels et al.
3,322,381 A 5/1967 Bubb
3,327,310 A 6/1967 Bethune et al.
3,333,808 A 8/1967 Du Boff
3,350,120 A 10/1967 Hinrichs
3,433,510 A 3/1969 Hulterstrum
3,529,860 A 9/1970 Jelley
3,592,434 A 7/1971 Murray
3,603,098 A 9/1971 Groetschel
3,604,397 A 9/1971 Salerno
3,608,991 A 9/1971 Wade
3,713,643 A 1/1973 Gerstenberger
3,767,253 A 10/1973 Kluetsch
3,792,510 A 2/1974 Evett
3,822,850 A 7/1974 Elias
3,861,663 A 1/1975 Strickland
3,952,877 A 4/1976 Kindl
3,956,784 A 5/1976 Vargas
3,972,272 A 8/1976 Bagby
4,077,083 A 3/1978 Siemund et al.
4,078,756 A 3/1978 Cross
4,087,006 A 5/1978 Schill
4,111,217 A 9/1978 Victor
4,139,101 A 2/1979 Towfigh
4,277,863 A 7/1981 Faneuf
4,379,654 A 4/1983 Rovelli
4,396,325 A 8/1983 Joice-Cavanagh
4,488,651 A 12/1984 Bishop
4,502,256 A 3/1985 Hahn
4,536,924 A 8/1985 Willoughby
4,576,354 A 3/1986 Blessing, Sr.
4,592,797 A 6/1986 Carlson
4,645,473 A 2/1987 Mochizuki
4,662,034 A 5/1987 Cunningham
4,708,189 A 11/1987 Ward
4,715,089 A 12/1987 Schema
4,717,107 A 1/1988 Servadio
4,770,086 A 9/1988 Gabster
4,794,974 A 1/1989 Melino
4,824,302 A 4/1989 Schultheis et al.
4,852,844 A 8/1989 Villaveces
4,874,028 A 10/1989 Lynch et al.
4,885,876 A 12/1989 Henke
4,907,835 A 3/1990 Salters
4,912,814 A 4/1990 McKenzie
4,926,522 A 5/1990 Wang
4,969,241 A 11/1990 Griffin
5,038,889 A 8/1991 Jankowski
5,040,915 A 8/1991 Stuart et al.
5,056,753 A 10/1991 Lunau et al.
5,078,348 A 1/1992 Babitchenko
5,116,012 A 5/1992 Offenhauer et al.
5,129,774 A 7/1992 Balseiro et al.
5,170,974 A 12/1992 Ruggiero
5,240,058 A 8/1993 Ward
5,287,614 A 2/1994 Ehrlich
5,299,773 A 4/1994 Bertrand
5,301,915 A 4/1994 Bahniuk et al.
5,308,280 A 5/1994 Dotson
5,322,403 A 6/1994 Herde
5,331,706 A 7/1994 Graham
5,345,989 A 9/1994 Brophy
5,375,303 A 12/1994 Shenier
5,379,491 A 1/1995 Solo
5,384,938 A 1/1995 Frederick
5,388,283 A 2/1995 Garnett
5,404,602 A 4/1995 Kondo
5,469,607 A 11/1995 Henningsson et al.
5,497,537 A 3/1996 Robinson et al.
5,524,693 A 6/1996 Hamilton
5,529,326 A 6/1996 Hwang
5,536,229 A 7/1996 Albergo
5,542,209 A 8/1996 Sheu
5,551,115 A 9/1996 Newville
5,555,607 A 9/1996 Parveris
5,558,501 A 9/1996 Wang et al.
5,584,456 A 12/1996 Stephens
5,611,514 A 3/1997 Oliver et al.
5,640,826 A 6/1997 Hurilla, Jr.
5,645,272 A 7/1997 Brennan, Sr.
5,649,780 A 7/1997 Schall
5,666,702 A 9/1997 Ming-Chieh
5,673,741 A 10/1997 Cairns
5,707,032 A 1/1998 Ehrlich
5,715,620 A 2/1998 Walker
5,722,691 A 3/1998 Patel
5,803,653 A 9/1998 Zuffetti
5,884,424 A 3/1999 Smith
5,897,085 A 4/1999 Cronin
5,924,469 A 7/1999 Whittemore
5,937,488 A 8/1999 Geiger
5,940,942 A 8/1999 Fong
5,941,434 A 8/1999 Green
5,941,586 A 8/1999 Fann
5,979,110 A 11/1999 Tai
6,067,691 A 5/2000 Feltman
6,152,434 A 11/2000 Gluck
6,164,605 A 12/2000 Drake et al.
6,170,112 B1 1/2001 Mayfield et al.
6,209,615 B1 4/2001 Whittemore
6,321,823 B1 11/2001 Whittemore
6,341,401 B1 1/2002 Lin
6,378,175 B1 4/2002 Vanderpan
6,467,741 B1 10/2002 Shih
6,474,609 B1 11/2002 Pinard
6,490,749 B1 12/2002 Morad
6,508,295 B2 1/2003 Whittemore
6,523,231 B1 2/2003 Lassiter
6,718,589 B2 4/2004 Kimbro
6,942,004 B2 9/2005 Whittemore
6,953,076 B2 10/2005 Whittemore
6,982,004 B1 * 1/2006 Malik ..... A61F 2/91 118/309
7,073,758 B2 7/2006 Whittemore et al.
7,108,040 B2 9/2006 Whittemore
7,261,140 B2 8/2007 Whittemore
7,503,373 B2 3/2009 Whittemore
7,533,712 B2 5/2009 Whittemore et al.
7,658,219 B2 2/2010 Whittemore

(56) References Cited

U.S. PATENT DOCUMENTS

| | | | | |
|---|---|---|---|---|
| 7,717,382 | B2 | 5/2010 | Whittemore et al. | |
| 7,743,512 | B1 | 6/2010 | Whittemore | |
| 8,066,051 | B2 | 11/2011 | Whittemore | |
| 8,072,739 | B2 | 12/2011 | Dittmer | |
| 8,113,475 | B2 | 2/2012 | Whittemore et al. | |
| 8,196,877 | B2 | 6/2012 | Gridley et al. | |
| 8,371,360 | B2 | 2/2013 | Whittemore | |
| 8,627,873 | B2 | 1/2014 | Whittemore | |
| 8,857,499 | B2 | 10/2014 | Whittemore | |
| 9,062,466 | B2 | 6/2015 | Glynos | |
| 9,062,468 | B2 | 6/2015 | Behringer | |
| 9,115,539 | B2 | 8/2015 | Whittemore | |
| 9,441,392 | B2 | 9/2016 | Whittemore | |
| 9,657,514 | B1 | 5/2017 | Whittemore | |
| 9,663,962 | B1 | 5/2017 | Whittemore | |
| 10,081,955 | B2 * | 9/2018 | Whittemore | E04G 21/243 |
| 2001/0029640 | A1 | 10/2001 | Cassar | |
| 2002/0092107 | A1 | 7/2002 | Kimbro | |
| 2003/0154588 | A1 | 8/2003 | Blacket et al. | |
| 2004/0065799 | A1 * | 4/2004 | Whittemore | E04G 21/30 248/354.1 |
| 2004/0194418 | A1 | 10/2004 | Gouley | |
| 2004/0200585 | A1 | 10/2004 | Whittemore | |
| 2005/0247414 | A1 * | 11/2005 | Whittemore | E04G 21/24 160/351 |
| 2007/0102603 | A1 | 5/2007 | Newell | |
| 2009/0278016 | A1 | 11/2009 | Gridley et al. | |
| 2010/0091438 | A1 | 4/2010 | Dittmer | |
| 2011/0192522 | A1 | 8/2011 | Whittemore | |
| 2014/0263916 | A1 * | 9/2014 | Behringer | E04G 21/243 248/357 |
| 2015/0052843 | A1 * | 2/2015 | Whittemore | E04G 21/24 52/632 |
| 2015/0135609 | A1 | 5/2015 | Glynos | |
| 2016/0356040 | A1 | 12/2016 | Whittemore | |
| 2017/0009473 | A1 | 1/2017 | Whittemore | |
| 2017/0009474 | A1 | 1/2017 | Whittemore | |
| 2017/0020322 | A1 | 1/2017 | Whittemore | |
| 2017/0067263 | A1 * | 3/2017 | Rosati | E04G 11/50 |

FOREIGN PATENT DOCUMENTS

| | | |
|---|---|---|
| DE | 4420849 | 12/1995 |
| DE | 29605222 | 7/1996 |
| FR | 2411282 | 7/1979 |
| GB | 957439 | 5/1964 |
| GB | 1042086 | 9/1966 |
| GB | 2156894 | 10/1985 |
| JP | 5323110 | 3/1978 |
| WO | 8603538 | 6/1986 |
| WO | 9109556 | 7/1991 |
| WO | 9427480 | 12/1994 |

OTHER PUBLICATIONS

ISRWO dated Oct. 7, 2016 issued in corresponding International Application No. PCT/US2016/43474.

"Partition Mount System Including Head Coupler With Adjustable Head Length and Head Position" Specification, Drawings and Prosecution History of U.S. Appl. No. 15/216,877, filed Jul. 22, 2016, now issued U.S. Pat. No. 10,081,955, issued on Sep. 25, 2018 by Jeffrey Whittemore.

Chinese Office Action dated Aug. 28, 2018 issued in corresponding Chinese Application No. 201680053500.9, with English translation.

* cited by examiner

PARTITION MOUNT SYSTEM INCLUDING HEAD COUPLER WITH ADJUSTABLE HEAD LENGTH AND HEAD POSITION

RELATED APPLICATIONS

This application is a continuation application of U.S. patent application Ser. No. 15/216,877, filed Jul. 22, 2016, which claims the benefit of U.S. Provisional Patent Application Ser. No. 62/196,598, filed Jul. 24, 2015, the content of which is incorporated herein by reference, in its entirety.

This application is related to U.S. Pat. No. 5,924,469, issued on Jul. 20, 1999, U.S. Pat. No. 7,658,219, issued on Feb. 9, 2010, U.S. Pat. No. 7,073,758, issued on Jul. 11, 2006, U.S. Pat. No. 7,533,712, issued on May 19, 2009, and U.S. Pat. No. 7,743,512, issued on Jun. 29, 2010, the contents of each being incorporated herein by reference in their entirety.

BACKGROUND

Partition systems are often employed to isolate portions of a building or room, by serving as a barrier to dust, noise, light, odors, and the like. In construction zones, partitions are useful for protecting a clean area from a work area, for example, protecting an area where furniture and rugs are temporarily stored from an area where wood floors are being refinished.

Workers at construction sites often use rudimentary techniques for installing partitions. Some simply nail, screw, or staple the curtain or partition material to the floor, ceiling, and abutting walls, resulting in damage to their surfaces. Other people setting up a barrier use tape or other adhesives which could resulting in paint being removed from the wall or the adhesive material being difficult to remove. The tape usually fails to stick, but if it does stick, as the tape is removed, paint can pull off with the tape, or adhesive is left behind.

U.S. Pat. No. 5,924,469, the content of which is incorporated herein by reference, discloses a partition mount system that addresses these limitations. This system offers the advantage of accommodating standard extension poles, for example, painters poles, with standard threads, and is compatible with a variety of commercially-available curtain or drape materials, for example plastic, cloth, and the like. The disclosed system is a "clean" system designed to be installed and removed without damaging or otherwise marking the ceiling, floor or walls in the construction zone. Assembly is easy and fast and can be accomplished by a single individual. In certain applications however, a sag, or gap, may be present in the curtain along a mounting pole next to a wall, ceiling, door frame, or other abutting surface, compromising the effectiveness of the installation.

U.S. Pat. No. 7,533,712, the content of which is incorporated herein by reference, discloses a mount system that mitigates or eliminates sag, or gaps, between an installed curtain and an abutting surface such as a wall or ceiling. The system accomplishes this in a manner that avoids permanent damage to the wall or ceiling surface. The system includes a head having an elongated body and a compressible curtain interface. A pole, for example, as described in connection with U.S. Pat. Nos. 5,924,469 and 7,658,219, may be configured to urge the head the curtain and abutting surface, thereby eliminating a sag or gap in the curtain.

In certain configurations, a pole supporting the elongated body of the head may be positioned so as to inhibit human movement. In addition, a single elongated head may not be long enough to eliminate all of the sag in the partition system, and, thus, multiple poles and corresponding elongated heads may be required.

SUMMARY

Embodiments of the present inventive concepts are directed to a partition mounting system and method of installing the same. The system and method provide a mechanism for convenient installation of one or more elongated bodies for improved elimination of sag at an upper portion of an installed curtain. In particular, a coupler may be provided for coupling one or more of the elongated bodies to each other. Optionally, the coupler may further provide a mechanism for coupling to a pivot joint of a supporting pole. In various configurations, the system may be configured so that the pole supports two elongated bodies at the coupler. Alternatively, the system may be configured so that first and second poles can support the elongated bodies at their respective ends, the elongated bodies in turn being joined in a sliding relationship at the coupler.

In an aspect, a coupler comprises a first channel having a first axis of extension in a first horizontal direction and a second channel having a second axis of extension in the first horizontal direction. The second axis of extension is parallel to and spaced apart from the first axis of extension in a second horizontal direction. The second axis of extension has a pitch angle relative to the first axis of extension in a vertical direction, the pitch angle being less than 180 degrees. The first channel includes first head-mounting features, the head-mounting features constructed and arranged to retain a first elongated head to the coupler while permitting movement of the first elongated head relative to the coupler in the first horizontal direction. The second channel includes second head-mounting features, the head-mounting features constructed and arranged to retain a second elongated head to the coupler while permitting movement of the second elongated head relative to the coupler in the second horizontal direction.

In some embodiments, the first and second head-mounting features each include at least one row of retention tabs.

In some embodiments, the at least one row of retention tabs includes first and second rows of retention tabs spaced apart from each other and opposite each other in the second horizontal direction.

In some embodiments, the at least one row of retention tabs includes first and second rows of four retention tabs spaced apart from each other in the first horizontal direction and spaced apart and opposite each other in the second horizontal direction.

In some embodiments, the retention tabs have an L-shaped cross section.

In some embodiments, the retention tabs of the first channel are below the retention tabs of the second channel in the vertical direction at a first portion of the coupler and wherein the retention tabs of the first channel are above the retention tabs of the second channel in the vertical direction at a first portion of the coupler.

In some embodiments, the coupler further comprises a first elongated head having a length more than two-times a length of the first channel in the first horizontal direction and a second elongated head having a length more than two-times a length of the second channel in the first horizontal direction.

In some embodiments, the coupler further comprises a locking mechanism that locks a position of the first elongated head in the first channel and locks a position of the second elongated head in the second channel.

In some embodiments, the locking mechanism comprises a body having first and second lobes positioned in the first and second channels, the body constructed and arranged to pivot so that the first and second lobes interfere with the first and second channels to prevent sliding of a first elongated head inserted in the first channel and to prevent sliding of a second elongated head in the second channel.

In some embodiments, the locking mechanism further comprises a tab to induce manual pivot of the lobes.

In some embodiments, the coupler further comprises a socket constructed and arranged to receive a ball of a support pole.

In some embodiments, the socket forms a universal joint with an inserted ball of the support pole to permit pivot of the coupler relative to the support pole.

In some embodiments, the coupler further comprises first and second neck retainers spaced apart from each other and parallel to each other on opposite sides of the socket to limit pivot of the coupler relative to the pole to one degree of freedom about the second horizontal direction, and to prevent pivot of the coupler relative to the pole about the second horizontal direction.

In some embodiments, the pitch angle is between about 0.5 degrees and 10 degrees.

In some embodiments, the pitch angle is about 2.0 degrees.

In some embodiments, the first and second head-mounting features permit sliding movement of the first elongated head and second elongated head respectively relative to the coupler in the first horizontal direction.

In some embodiments, the first and second head-mounting features permit sliding movement of the first elongated head and second elongated head respectively beyond both a first end and a second end of each channel.

In another aspect, a system comprises: a first elongated head; a second elongated head; and a coupler. The coupler comprises a first channel having a first axis of extension in a first horizontal direction and a second channel having a second axis of extension in the first horizontal direction, the second axis of extension parallel to and spaced apart from the first axis of extension in a second horizontal direction. The second axis of extension has a pitch angle relative to the first axis of extension in a vertical direction, the pitch angle being less than 180 degrees. The first channel includes first head-mounting features, the head-mounting features constructed and arranged to retain the first elongated head to the coupler while permitting movement of the first elongated head relative to the coupler in the first horizontal direction. The second channel includes second head-mounting features, the head-mounting features constructed and arranged to retain the second elongated head to the coupler while permitting movement of the second elongated head relative to the coupler in the second horizontal direction.

In some embodiments, the first and second elongated head each comprise: a base having a capture constructed and arranged to interface with the head mounting features of the coupler; and a compressible pad on the base.

In some embodiments, the capture of the base comprises an elongated groove.

In some embodiments, the base comprises an extruded rail including the elongated groove.

In some embodiments, the first and second head-mounting features each include at least one row of retention tabs.

In some embodiments, the at least one row of retention tabs includes first and second rows of retention tabs spaced apart from each other and opposite each other in the second horizontal direction.

In some embodiments, the at least one row of retention tabs includes first and second rows of four retention tabs spaced apart from each other in the first horizontal direction and spaced apart and opposite each other in the second horizontal direction.

In some embodiments, the retention tabs have an L-shaped cross section.

In some embodiments, the retention tabs of the first channel are below the retention tabs of the second channel in the vertical direction at a first portion of the coupler and wherein the retention tabs of the first channel are above the retention tabs of the second channel in the vertical direction at a first portion of the coupler.

In some embodiments, the first elongated head is of a length more than two-times a length of the first channel in the first horizontal direction and wherein the second elongated head is of a length more than two-times a length of the second channel in the first horizontal direction.

In some embodiments, the system further comprises a locking mechanism that locks a position of the first elongated head in the first channel and locks a position of the second elongated head in the second channel.

In some embodiments, the locking mechanism comprises a body having first and second lobes positioned in the first and second channels, the body constructed and arranged to pivot so that the first and second lobes interfere with the first and second channels to prevent sliding of a first elongated head inserted in the first channel and to prevent sliding of a second elongated head in the second channel.

In some embodiments, the locking mechanism further comprises a tab to induce manual pivot of the lobes.

In some embodiments, the system further comprises a socket constructed and arranged to receive a ball of a support pole.

In some embodiments, the socket forms a universal joint with an inserted ball of the support pole to permit pivot of the coupler relative to the support pole.

In some embodiments, the system further comprises first and second neck retainers spaced apart from each other and parallel to each other on opposite sides of the socket to limit pivot of the coupler relative to the pole to one degree of freedom about the second horizontal direction, and to prevent pivot of the coupler relative to the pole about the second horizontal direction.

In some embodiments, the pitch angle is between about 0.5 degrees and 10 degrees.

In some embodiments, the pitch angle is about 2.0 degrees.

In some embodiments, the first and second head-mounting features permit sliding movement of the first elongated head and second elongated head respectively relative to the coupler in the first horizontal direction.

In some embodiments, the first and second head-mounting features permit sliding movement of the first elongated head and second elongated head respectively beyond both a first end and a second end of each channel.

In another aspect, a method of installing a dust partition system comprises: applying a first elongated head to a coupler, and applying a second elongated head to the coupler. The coupler comprises: a first channel having a first axis of extension in a first horizontal direction; a second channel having a second axis of extension in the first horizontal direction, the second axis of extension parallel to and spaced apart from the first axis of extension in a second horizontal direction, the second axis of extension having a pitch angle relative to the first axis of extension in a vertical direction, the pitch angle being less than 180 degrees. The first channel includes first head-mounting features, the head-mounting features constructed and arranged to retain the first elongated head to the coupler while permitting movement of the first elongated head relative to the coupler in the first horizontal direction. The second channel includes second head-mounting features, the head-mounting features constructed and arranged to retain the second elongated head to the coupler while permitting movement of the second elongated head relative to the coupler in the second horizontal direction. Positions of the first elongated head and the second elongated head are adjusted relative to each other by sliding them in the coupler relative to each other along the first axis of extension and the second axis of extension.

In some embodiments, the coupler further comprises a locking mechanism that locks a position of the first elongated head in the first channel and locks a position of the second elongated head in the second channel, and further comprising locking positions of the first elongated head and second elongated head relative to each other by engaging the locking mechanism.

BRIEF DESCRIPTION OF THE DRAWINGS

The foregoing and other features and advantages of the inventive concepts will be apparent from the more particular description of embodiments of the inventive concepts, as illustrated in the accompanying drawings in which like reference characters refer to the same parts throughout the different views. The drawings are not necessarily to scale, emphasis instead being placed upon illustrating the principles of the inventive concepts.

FIGS. 1G-1I are perspective views of the coupler of FIGS. 1A-1E coupled to extended-length foam rails in accordance with embodiments of the present inventive concepts. FIGS. 1H-1 and 1I-1 are conceptual diagrams illustrating different configurations of the coupler of FIGS. 1A-1I, in accordance with embodiments of the present inventive concepts.

DETAILED DESCRIPTION OF EMBODIMENTS

Figure 1A:
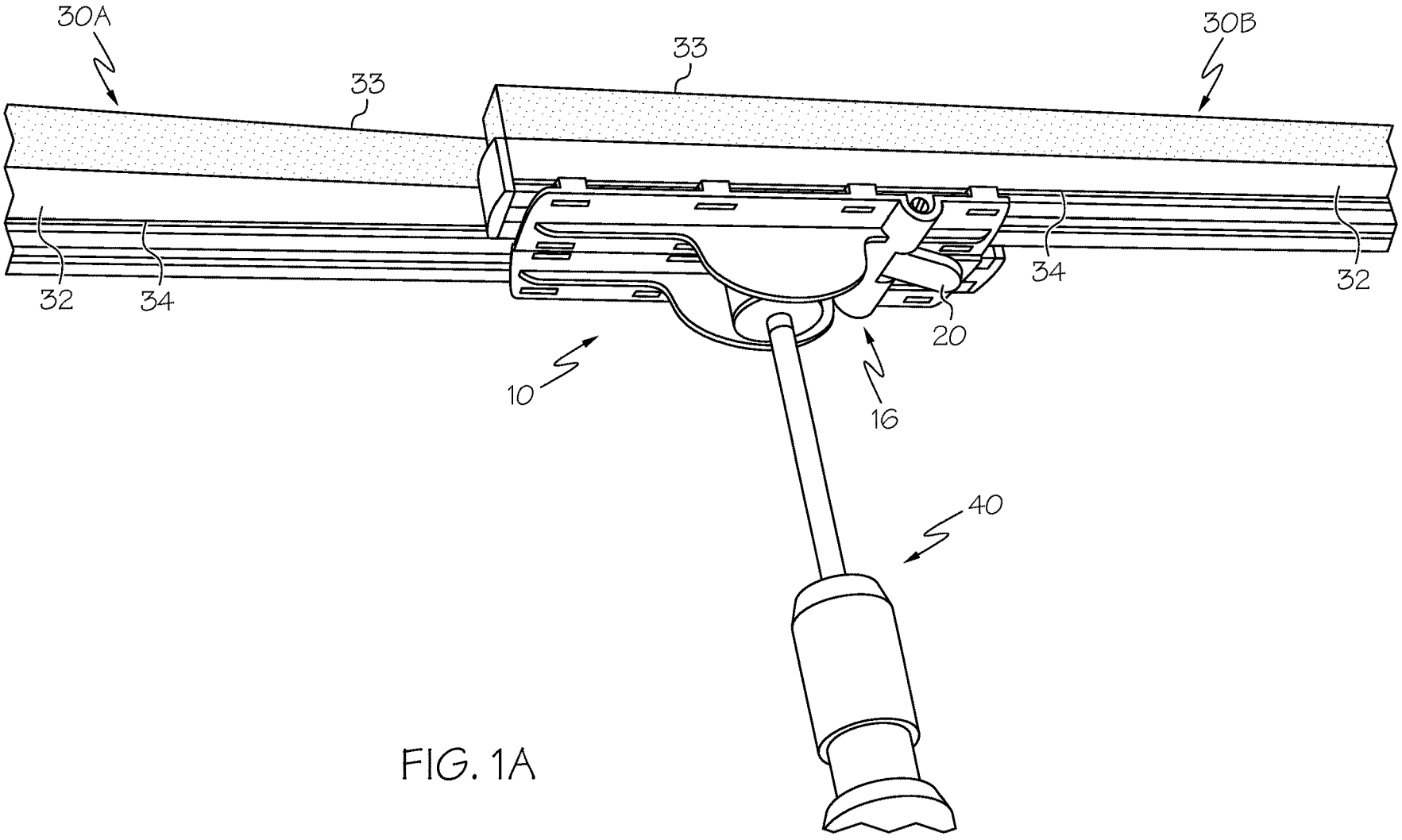
FIG. 1A is perspective view of a partition mount system in accordance with embodiments of the present inventive concepts.

Various example embodiments will be described more fully hereinafter with reference to the accompanying drawings, in which some example embodiments are shown. The present inventive concepts may, however, be embodied in many different forms and should not be construed as limited to the example embodiments set forth herein.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive concepts.

Spatially relative terms, such as "beneath," "below," "lower," "above," "upper" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present inventive concepts. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in such shapes.

Figure 1B:
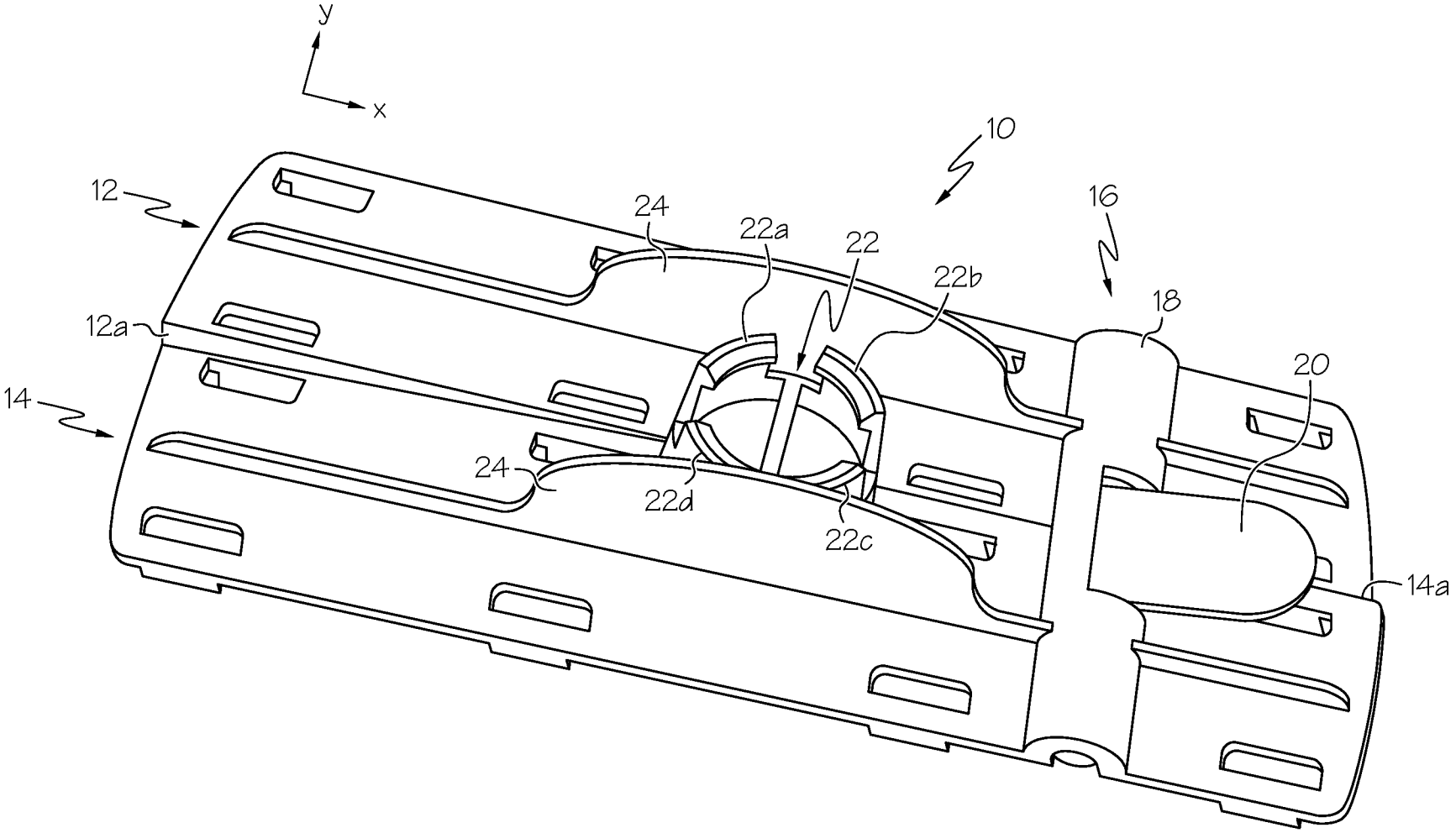
FIG. 1B-1E are perspective views of a coupler of FIG. 1A in accordance with embodiments of the present inventive concepts.
Figure 1C:
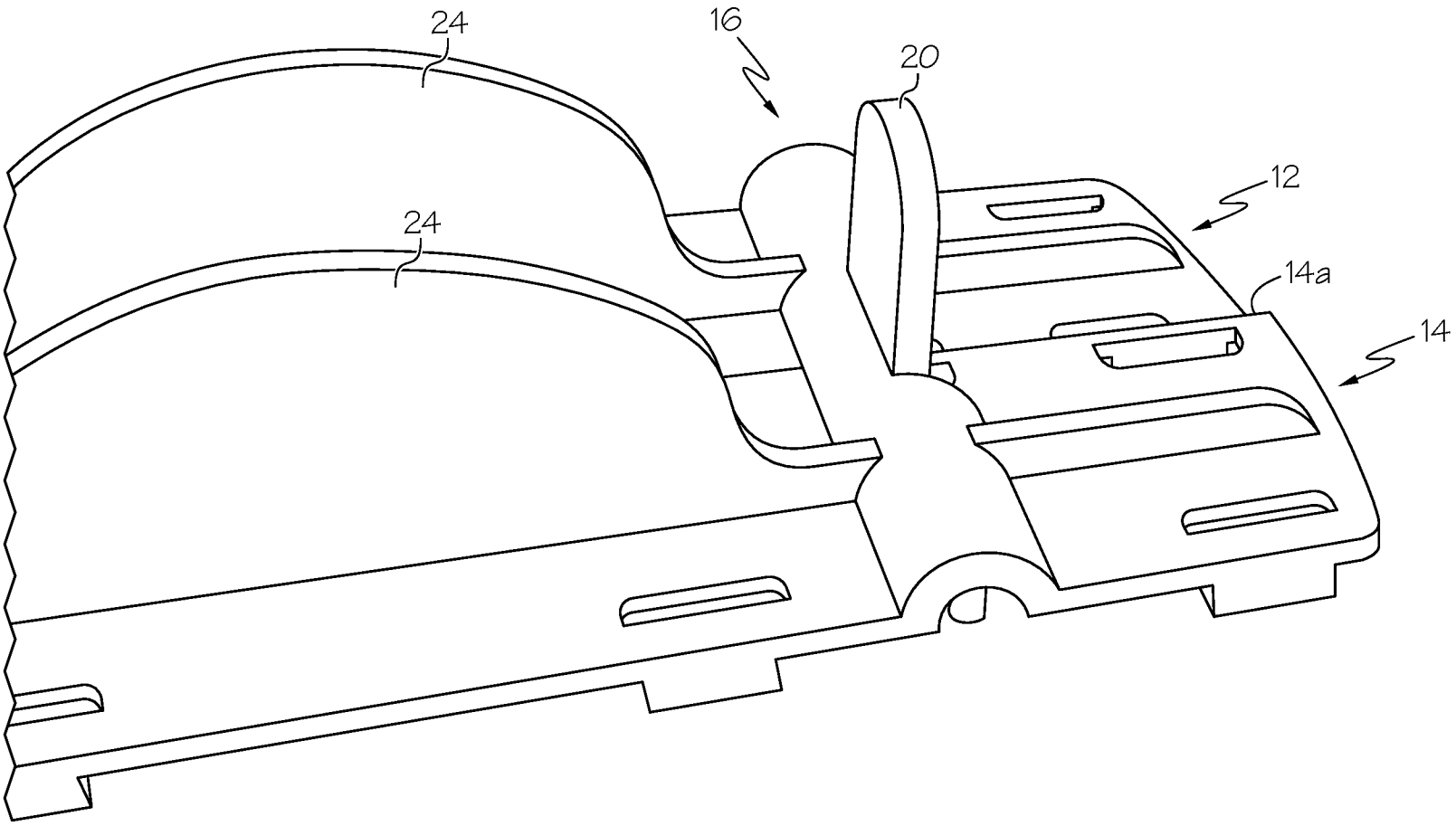
Figure 1D:
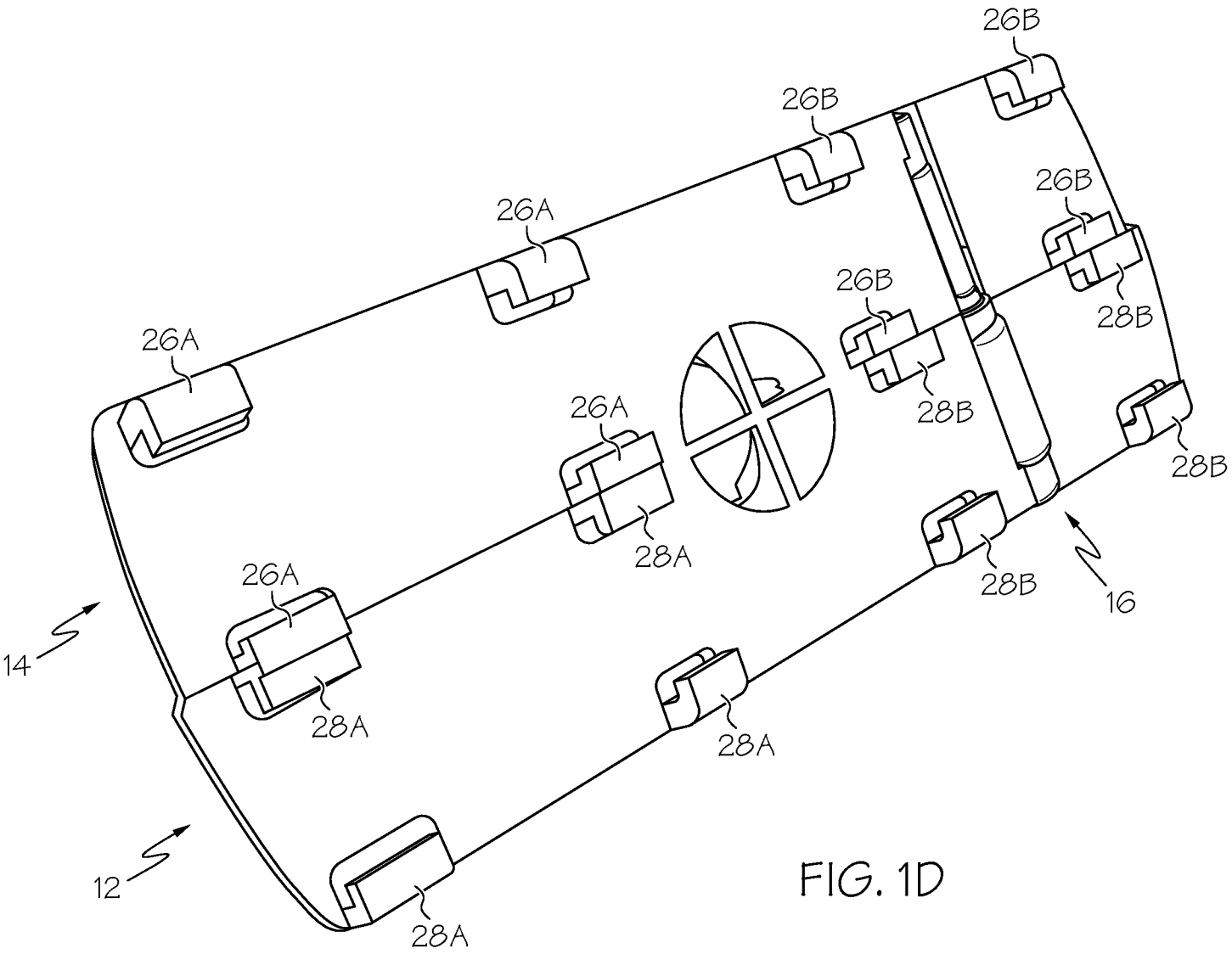
Figure 1E:
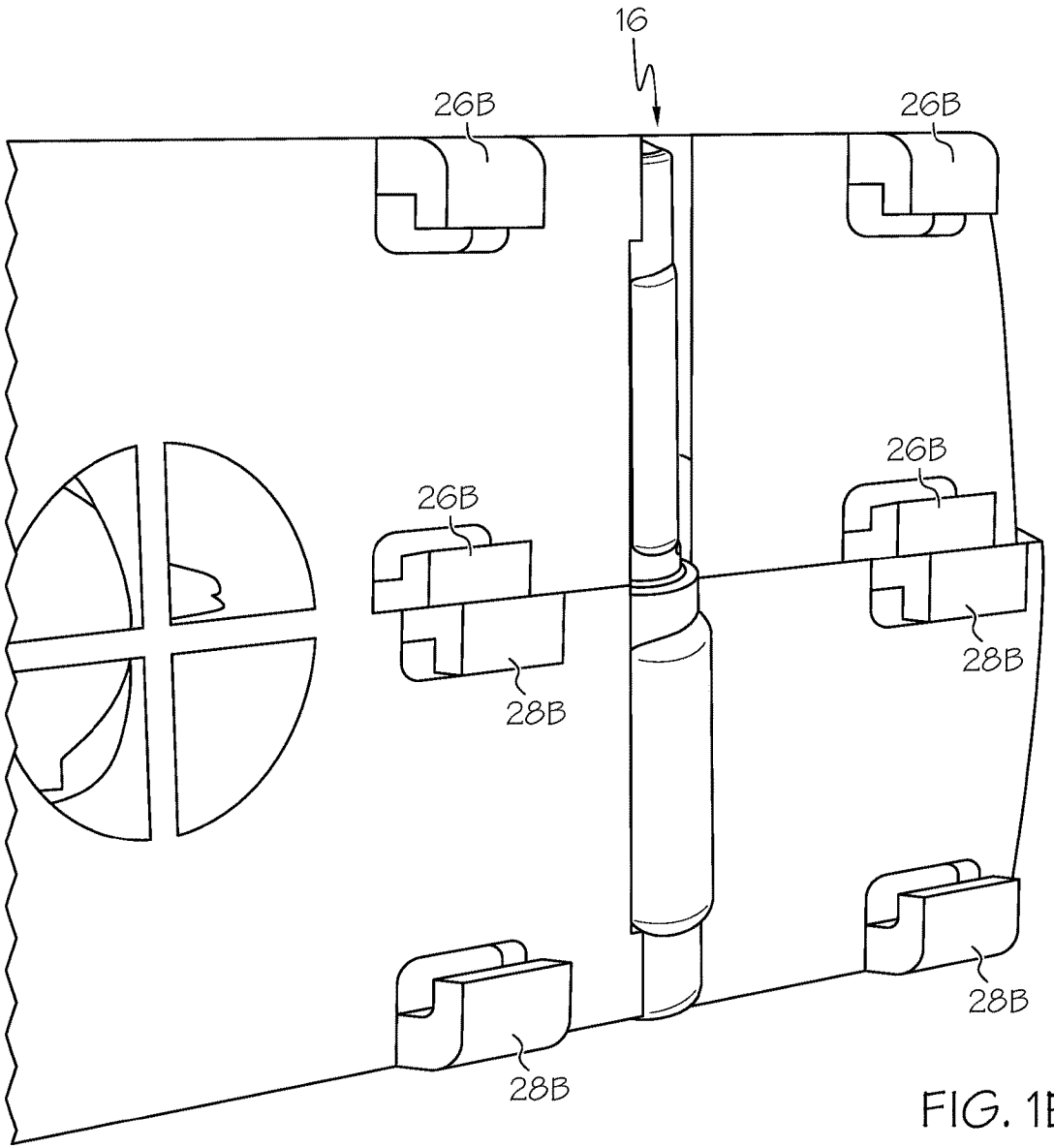
Figure 1F:
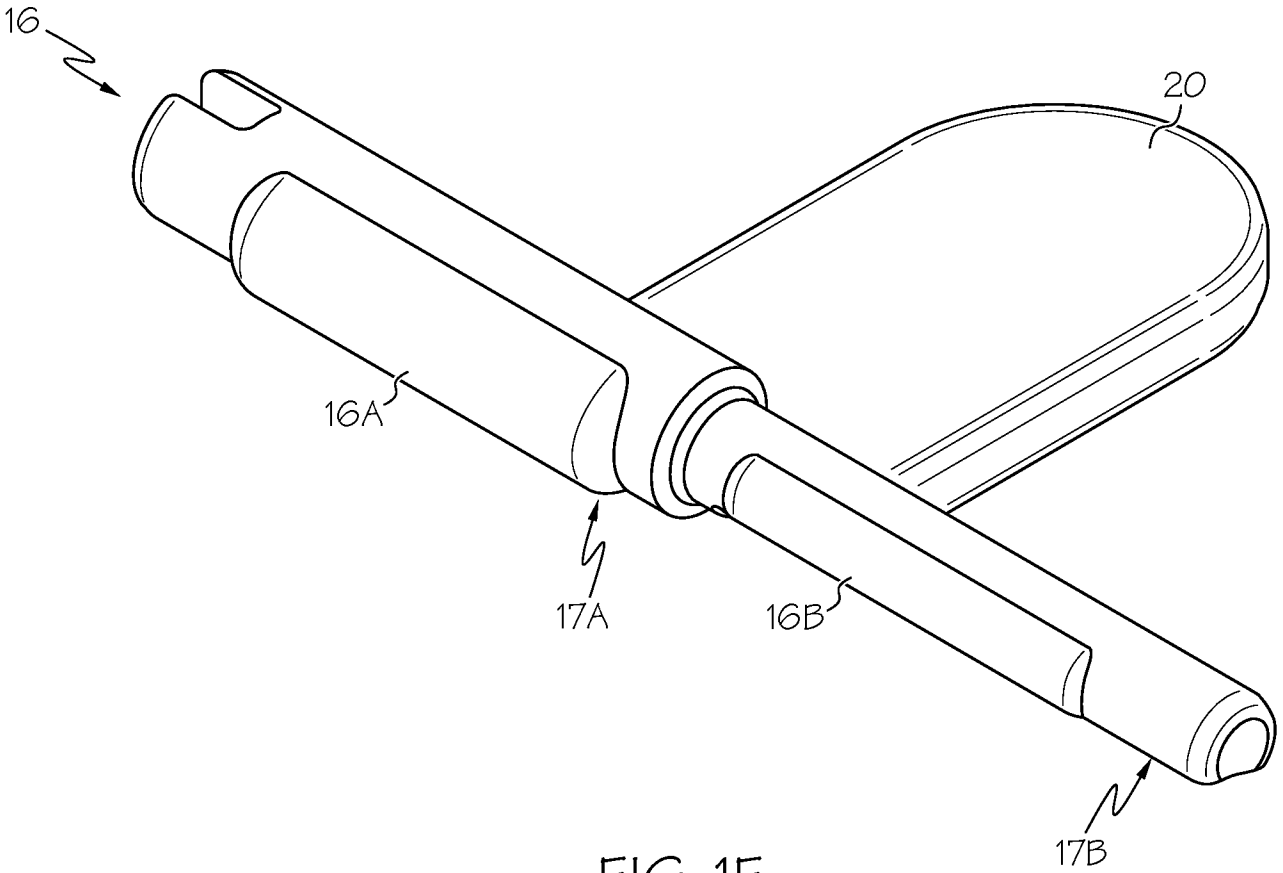
FIG. 1F is a perspective view of a locking mechanism of the coupler of FIGS. 1A-1E in accordance with embodiments of the present inventive concepts.
Figure 1G:
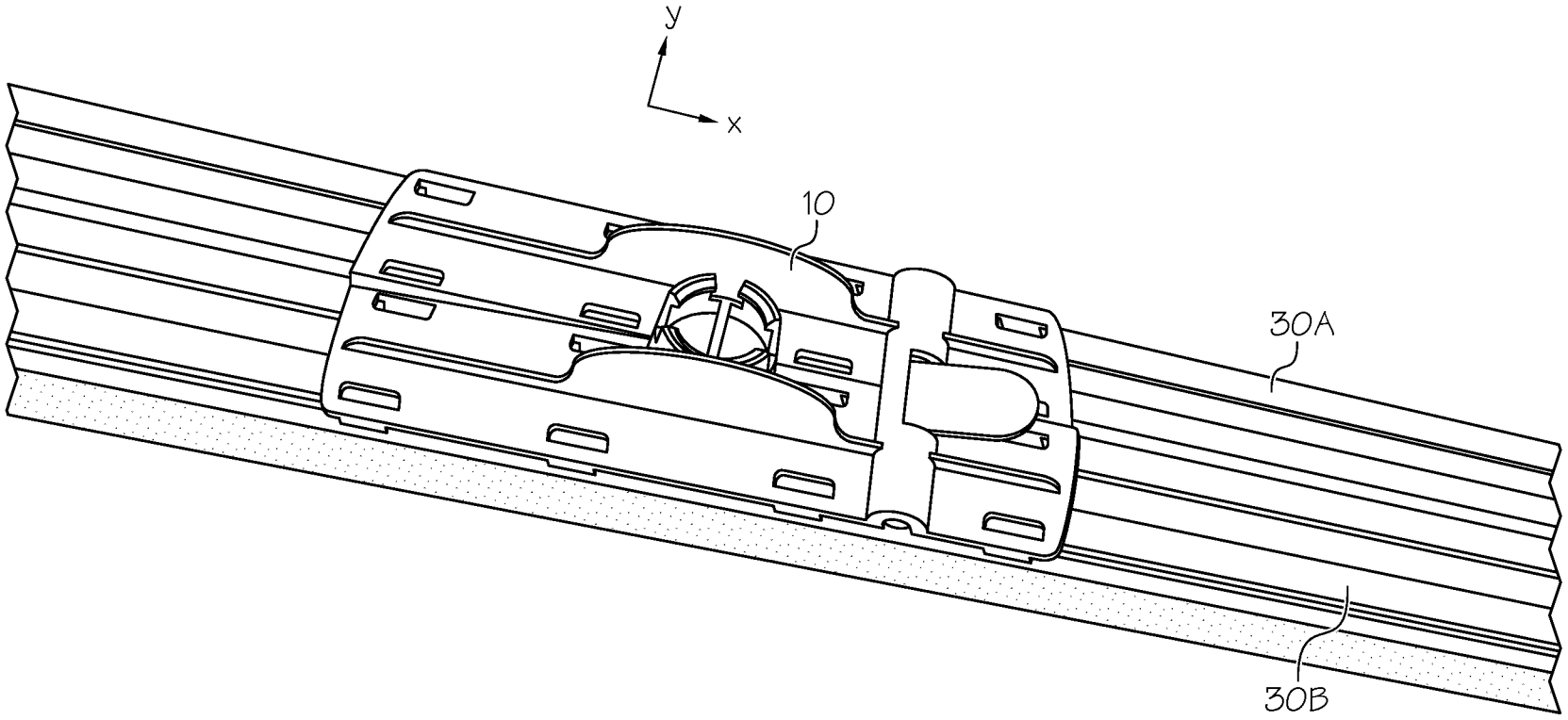
Figure 1H:
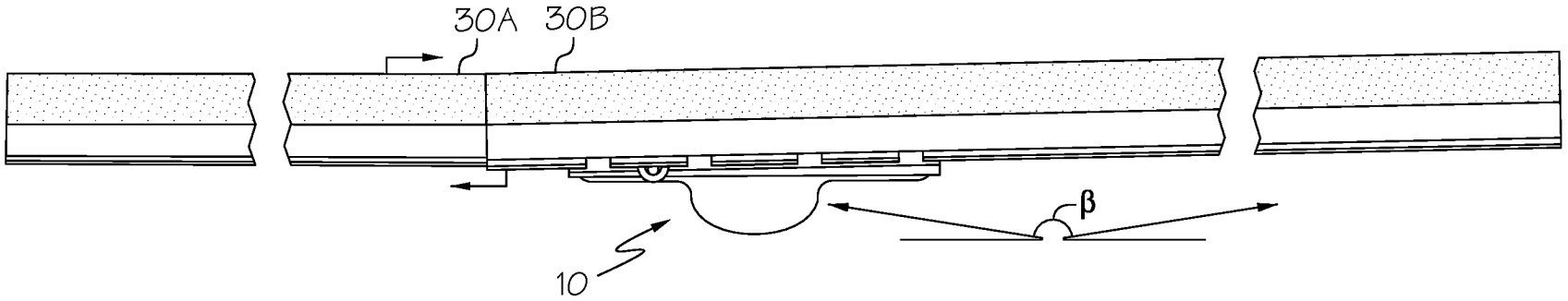
Figures 1, 1H:
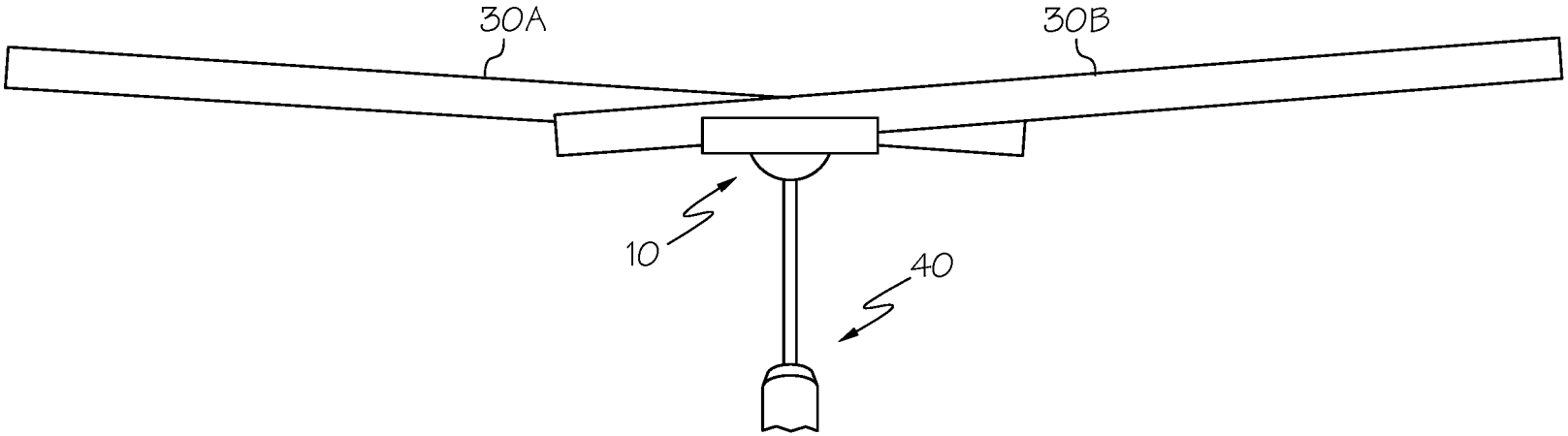
Figure 11:
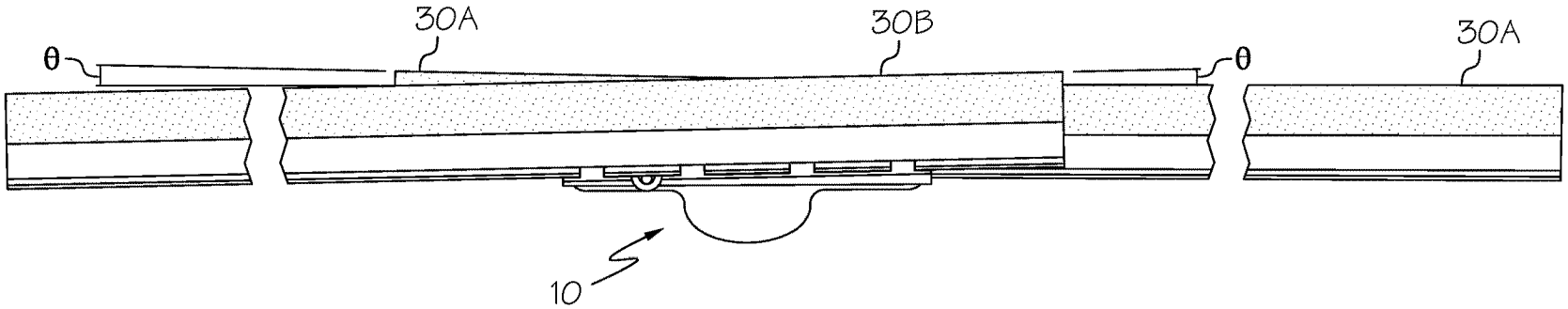
Figures 1, 11:
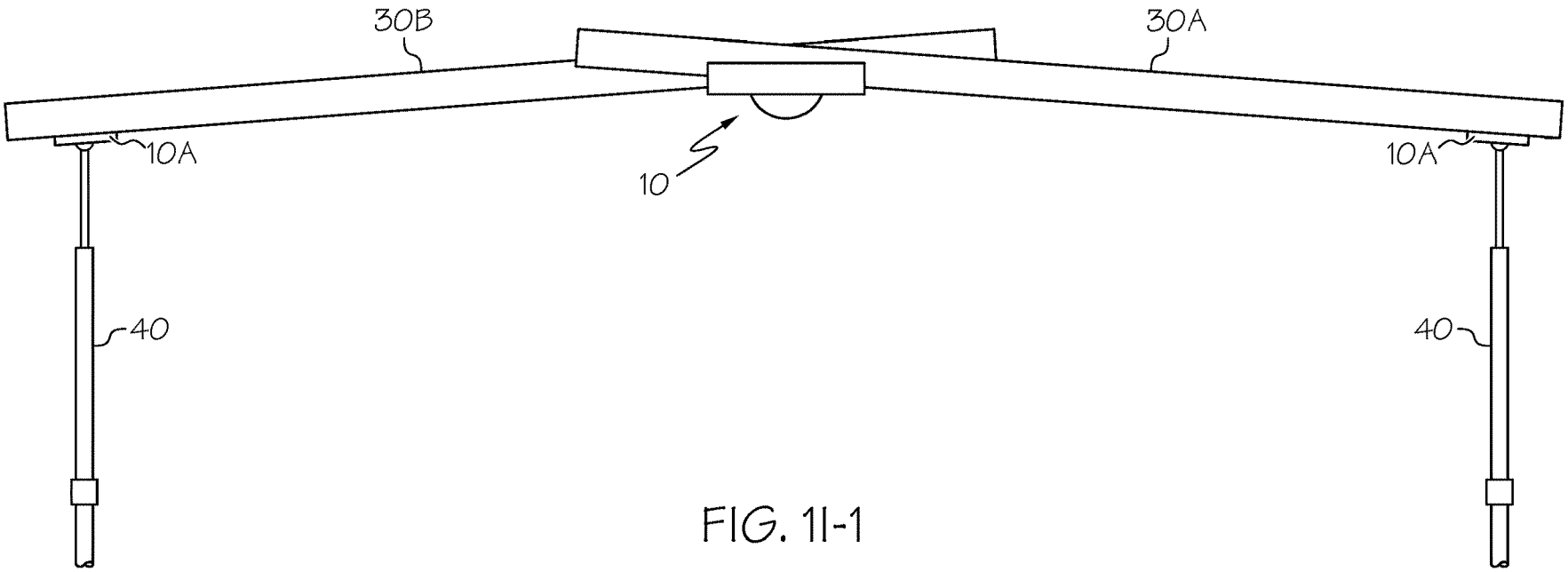

FIG. 1A is perspective view of a partition mount system in accordance with embodiments of the present inventive concepts. FIG. 1B-1D are perspective views of a coupler of FIG. 1A in accordance with embodiments of the present inventive concepts. FIG. 1E is a close-up view of the coupler of FIGS. 1A-1D in accordance with embodiments of the present inventive concepts. FIG. 1F is a perspective view of a locking mechanism of the coupler of FIGS. 1A-1D in accordance with embodiments of the present inventive concepts. FIGS. 1G-1I are perspective views of the coupler of FIGS. 1A-1D coupled to extended-length foam rails in accordance with embodiments of the present inventive concepts. FIGS. 1H-1 and 1I-1 are conceptual diagrams illustrating different configurations of the coupler of FIGS. 1A-1I, in accordance with embodiments of the present inventive concepts.

The partition mount system of FIG. 1A operates to mitigate or eliminate sag, or gaps, between an installed curtain and an abutting surface such as a wall or ceiling. The system accomplishes this in a manner that avoids permanent damage to the wall or ceiling surface. The system includes multiple heads 30A, 30B, each having elongated bodies and compressible curtain interfaces. In some embodiments, the heads can comprise lightweight aluminum, plastic or graphite rails with a compressible foam pad extending from an upper surface thereof.

The system can include, for example, a first head 30A and a second head 30B. The first and second heads 30A and 30B are joined together by a coupler 10. In some embodiments, the heads 30A, 30B slide though first and second channels of the coupler 10 so that they are slidably coupled together by the coupler 30. In this manner, the combined longitudinal length of the first and second heads 30A, 30B can be freely adjusted. An extendable pole 40, for example, of the type as described in connection with U.S. Pat. Nos. 5,924,469 and 7,658,219, the contents of which are incorporated herein by reference, may be configured to urge the coupler 10, heads 30A, 30B, and the curtain against an abutting surface, thereby eliminating a sag or gap in the curtain. In some embodiments, the extendable pole 40 may be spring-loaded to be thereby compressible between two surfaces of a room or hallway of a building.

As illustrated in FIGS. 1A-1E, each of the first and second heads 30A and 30B may include a head as described in connection with U.S. Pat. No. 7,533,712, the content of which is incorporated herein by reference. Each of the first and second heads 30A and 30B may include an elongated rail 32 and a compressible pad 33, for example, a foam block. The rail 32 may comprise, for example, an extruded member formed of plastic, aluminum, alloy, graphite, wood, or the like. In some embodiments, the rail 32 may have a U-shaped profile. The pad 33 can be mounted in a cavity of the rail 32, and may be press-fit, or otherwise bonded, into place. The pad 33 may be, for example, rectangular in shape and may be formed of low-density foam or rubber, having a certain degree of compressibility so as to conform to an abutting surface, while still exhibiting resiliency and shape memory. The rail 32 may further include an elongated horizontal groove 34 on each outer side surface for interfacing with retention tabs 26A, 26B, 28A and 28B (see for example, FIG. 1D) of the coupler 10. Along with conforming to the shape of the abutting surface, the foam pad 33 is operable to avoid damage to the abutting surface.

The coupler 10 includes multiple channels, for example, first and second channels 12 and 14, respectively, constructed and arranged such that the first and second heads 30A, 30B may be inserted, located, and adjusted in position relative to each other therein, respectively.

Referring to FIG. 1B, in some embodiments, the coupler 10 includes a socket 22 having teeth 22*a-d* at a central, bottom location of the coupler 10 and optional neck retainers 24 extending in the first horizontal direction x along the bottom of coupler 10 with the socket 22 therebetween. The socket 22 is configured to receive a ball of pole 40. In some embodiments, the ball and socket 22 are in a snap-fit relationship and together form a universal joint for allowing rotation of the first and second heads 30A, 30B relative to the pole 40. The optional neck retainers 24 may be present to limit the rotation on the universal joint to one degree of freedom, for example, along a plane defined between the longitudinal axis of the heads 30A, 30B and the pole 40.

Referring to FIG. 1D, the coupler 10 includes retention tabs 26A, 26B, 28A and 28B along outer edges of first and second channels 12 and 14, respectively, and a locking mechanism 16 between an edge of the coupler 10 and the socket 22. The first and second heads 30A, 30B are inserted into channels 12 and 14 such that the retention tabs 26A, 26B, 28A and 28B slide freely along the horizontal grooves 34 of the rails 32 of the first and second heads 30A, 30B. A locking mechanism 16 includes tab 20, for locking the heads 30A, 30B into position in their channels 12, 14.

The first and second channels 12 and 14 extend in a first horizontal direction x, for example, a first horizontal direction. The first and second channels 12 and 14 are horizontally offset in a second horizontal direction y perpendicular to the first horizontal direction x. The horizontal axes of the first and second channels 12, 14 are pitched at an angle relative to each other in a vertical direction, such that the first channel 12 extends below the second channel 14 in a vertical direction along section 12*a* of channel 12 and the second channel 14 extends below the first channel 12 in a vertical direction along section 14*a* of the channel 14. The sections 12*a*, 14*a*, and the regions between them are thus pitched relative to each other so that the resulting channels 12, 14 lie along axes of extension that are at a non-zero angle relative to each other in a vertical direction, for example, in some embodiments, an angle ranging between about 0.5 degrees to about 10 degrees, for example an angle of about 2 degrees. An example of the pitch angle θ, β can be viewed, the side views of FIGS. 1H and 1I.

In this manner, the first channel having a first axis of extension in a first horizontal direction, while the second channel having a second axis of extension in the first horizontal direction. The second axis of extension is parallel to and spaced apart from the first axis of extension in a second horizontal direction, the second axis of extension having a pitch angle relative to the first axis of extension in a vertical direction. The pitch angle is non-zero and less than 180 degrees. The first channel includes first head-mounting features, the head-mounting features constructed and arranged to retain the first elongated head to the coupler while permitting movement of the first elongated head relative to the coupler in the first horizontal direction. The second channel includes second head-mounting features, the head-mounting features constructed and arranged to retain a second elongated head to the coupler while permitting movement of the second elongated head relative to the coupler in the second horizontal direction.

As illustrated in FIG. 1D, retention tabs 26A of channel 14 are offset in a vertical direction relative to retention tabs 28A of channel 12 such that retention tabs 26A extend above retention tabs 28A in a vertical direction and retention tabs 26B of channel 14 are offset in a vertical direction relative to retention tabs 28B of channel 12 such that retention tabs 26B extend below retention tabs 28B in a vertical direction. A close up of the relationship of retention tabs 28A and 28B is provided in FIG. 1E. The retention tabs 26A, 26B, 28A, 28B have a generally "L"-shaped cross-section and are oriented to face each other so as to interface with the elongated horizontal grooves 34 of the first and second heads 30A, 30B. The opposed retention tabs 26A, 26B, 28A, 28B can be set in pairs as shown or can be staggered. While the present embodiment illustrates the use of four pairs of opposed retention tabs 26A, 26B, 28A, 28B per channel 12, 14, any of a number of suitable retention tabs may be employed, for example, as few as a single, elongated, retention tab, to as many retention tabs as desired. In this manner, the channels 12, 14 are thereby defined.

FIG. 1F is a perspective view of a locking mechanism 16 of the coupler of FIGS. 1A-1D in accordance with embodiments of the present inventive concepts. The locking mechanism is engaged by tab 20 and rotates in a slot provided across the first and second channels 12, 14 of the coupler 10. When the locking mechanism is in an engaged position, interference bulbs 16A, 16B of the locking mechanism 16 operate to frictionally interfere with the undersides of the bodies of the rails 32 of the heads 30A, 30B, thereby fixing the heads 30A, 30B in place relative to the coupler 10. When the locking mechanism 16 is in a disengaged, or open, position, a flat surface 17A, 17B of the locking mechanism 16 is positioned to face the channels 12, 14 so that horizontal positions of the first and second heads 30A, 30B can be freely and slidably adjusted.

FIGS. 1G-1I are perspective views of the coupler of FIGS. 1A-1E with extended-length heads 30A, 30B coupled thereto, in accordance with embodiments of the present inventive concepts. Referring to FIG. 1G, it can be seen that the first and second heads 30A, 30B are inserted in respective channels of the coupler 10 in the first horizontal direction x so that the heads 30A, 30B are positioned parallel to each other in the second horizontal direction y.

In the example of FIG. 1H, it can be seen that first ends of each of the first and second heads 30A, 30B are inserted into their respective channels 12, 14. Due to the angular offset of the channels, it can be seen that, at this position, the longitudinal axes of the first and second heads 30A, 30B lie at a curved profile that has a generally concave shape relative to the ceiling, as shown in the schematic diagram of inset FIG. 1H-1.

In the example of FIG. 1I, it can be seen that first ends of each of the first and second heads 30A, 30B are inserted into their respective channels 12, 14 and the first and second heads are each slid through the channels almost throughout their lengths to their second ends. Due to the angular offset of the channels, it can be seen that, at this position, the longitudinal axes of the first and second heads 30A, 30B lie at a curved profile that has a generally convex shape relative to the ceiling, as shown in the schematic diagram of inset FIG. 1I-1.

Due to the offset angle of the channels and their respective parallel positions on the coupler 10, it is therefore possible to provide two head configurations in the mounted heads 30A, 30B. The two configurations are achievable by positioning the heads with first ends proximal to the coupler (first configuration) or by positioning the heads with first ends distal to the coupler (second configuration).

The first configuration of FIG. 1H, 1H-1 is especially useful in applications where the heads 30A, 30B are to be supported at a central position, by the coupler 10, since the outer ends of the heads 30A, 30B are upwardly biased in this configuration. Accordingly, as the coupler 10 is urged into position at a ceiling, or other room surface, by the support pole 40, by compression in the foam pad and by any available longitudinal flex in the heads 30A, 30B collectively operate to urge the heads 30A, 30B against the ceiling. In this manner, a dust partition curtain can be held in place against the room surface over the longer span of two head lengths 30A, 30B.

The second configuration of FIG. 1I, 1I-1 is especially useful in applications where the heads are to be supported at their opposite ends, since the inner ends of the heads are upwardly biased in this configuration owing to the pitch angle θ, β of the channels 12, 14. In the present configuration, coupler 10 is used to connect the heads 30A, 30B, but is unsupported by a pole. Instead, first and second auxiliary couplers 10A can be included for supporting the opposed ends of the respective heads 30A, 30B.

In some embodiments, the first and second auxiliary couplers 10A can be the same as coupler 10, with only one of the channels 12, 14 being utilized to couple to a corresponding head 30A, 30B passing through it. In other embodiments, the first and second auxiliary couplers 10A can comprise a dedicated head coupler having a single channel 12, 14 that interfaces with the horizontal groove 34 of the head 30A, 30B and having a universal joint socket that interfaces with a ball of the support pole 40, for example, of the type described in U.S. Pat. No. 7,533,712, incorporated by reference herein.

Accordingly, as the coupler 10 is urged into position at a ceiling, or other room surface, by the first and second support poles 40, compression in the foam pad of the pole and any available longitudinal flex in the heads 30A, 30B collectively operate to urge the heads 30A, 30B against the ceiling. In this manner, a dust partition curtain can be held in place against the room surface over the longer span of two head lengths 30A, 30B, and at the outer ends of the heads 30A, 30B, while being unsupported in the center region.

In some embodiments, a system of head clips and feet can provide a system for additionally supporting first and second heads 30A, 30B joined at proximal ends by coupler 10 at their distal ends, in accordance with the present inventive concepts.

Figure 2A:
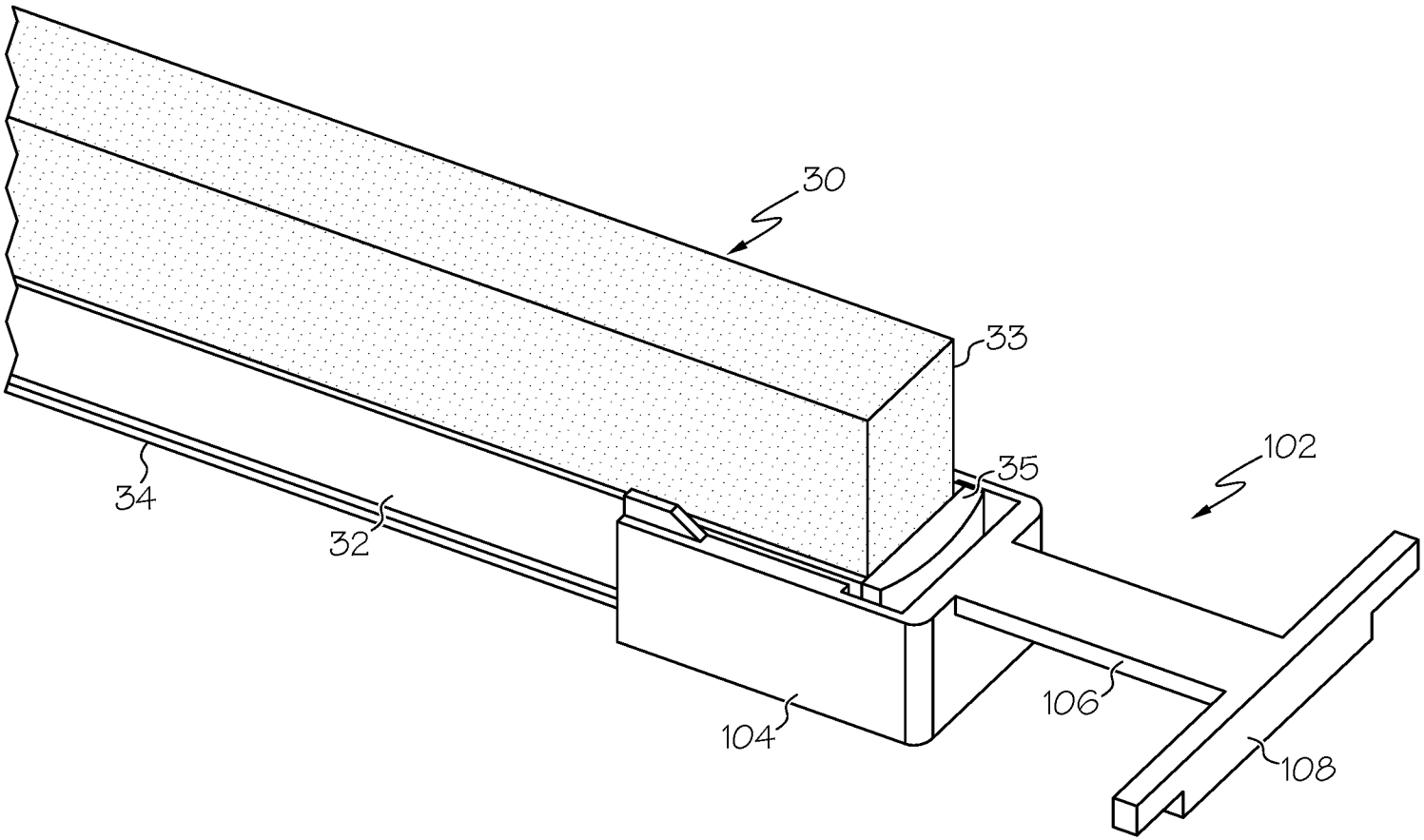
FIGS. 2A-2B are perspective views of a first end connector in accordance with embodiments of the present inventive concepts.
Figure 2B:
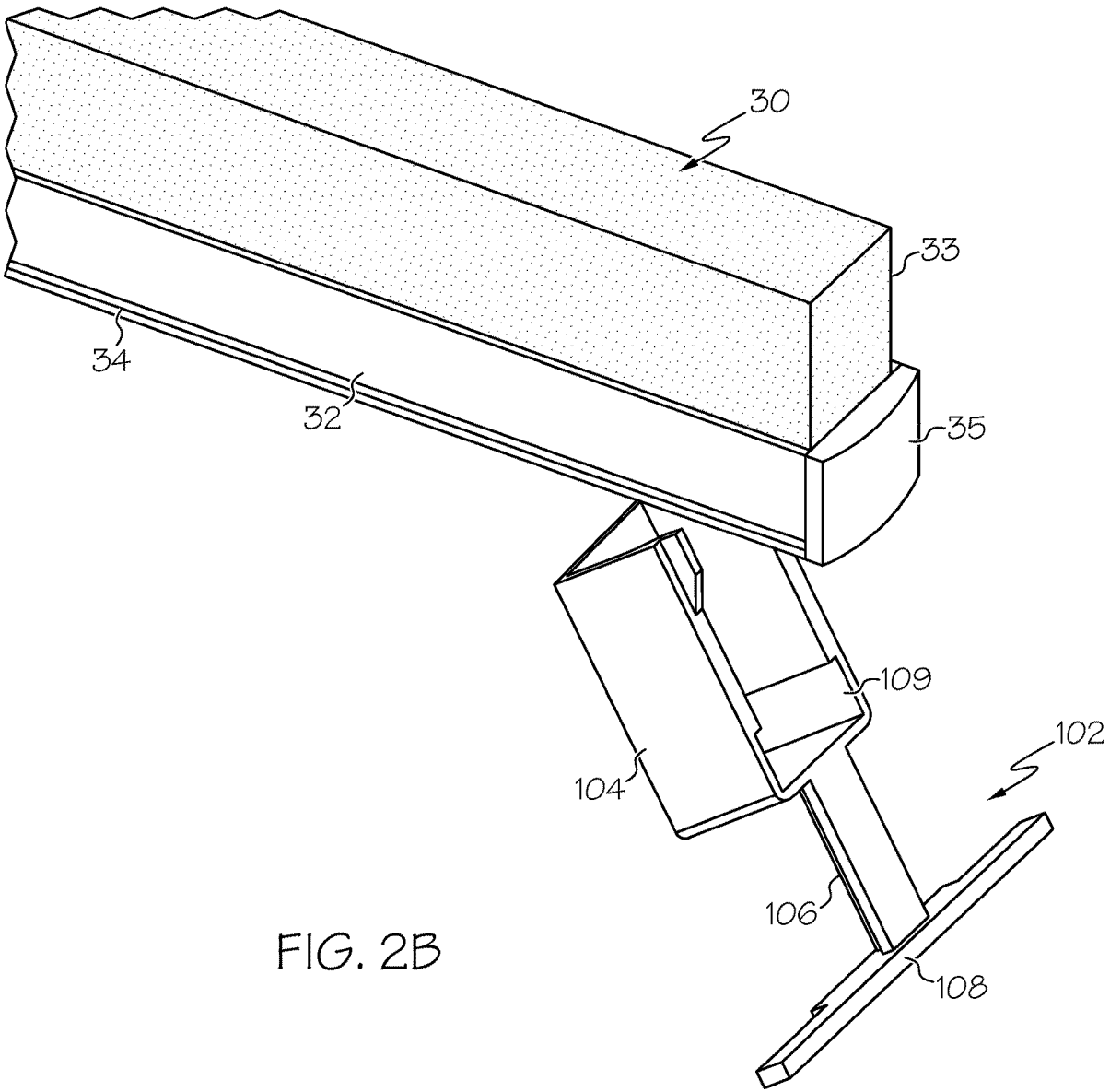

FIGS. 2A-2B are perspective views of a first end connector in accordance with embodiments of the present inventive concepts. A first end connector 102 includes a base portion 104 that pivotally snap-fits onto an end of the rail 32 of the head 30. An arm bridge 106 extends from the base portion 104, and a "T" cross member 108 is provided at an end of the arm bridge 106. The T-cross member includes first and second anus that extend in a direction perpendicular to the direction of extension of the arm bridge 106.

Referring to FIG. 2B, in some embodiments, the first end connector 102 can have a pivotable snap-fit relationship with the rail 32 of the end of the head 30. A recess 109 in the first end connector 102 can be configured to receive an end cap 35 of the head rail 32.

Figure 3A:
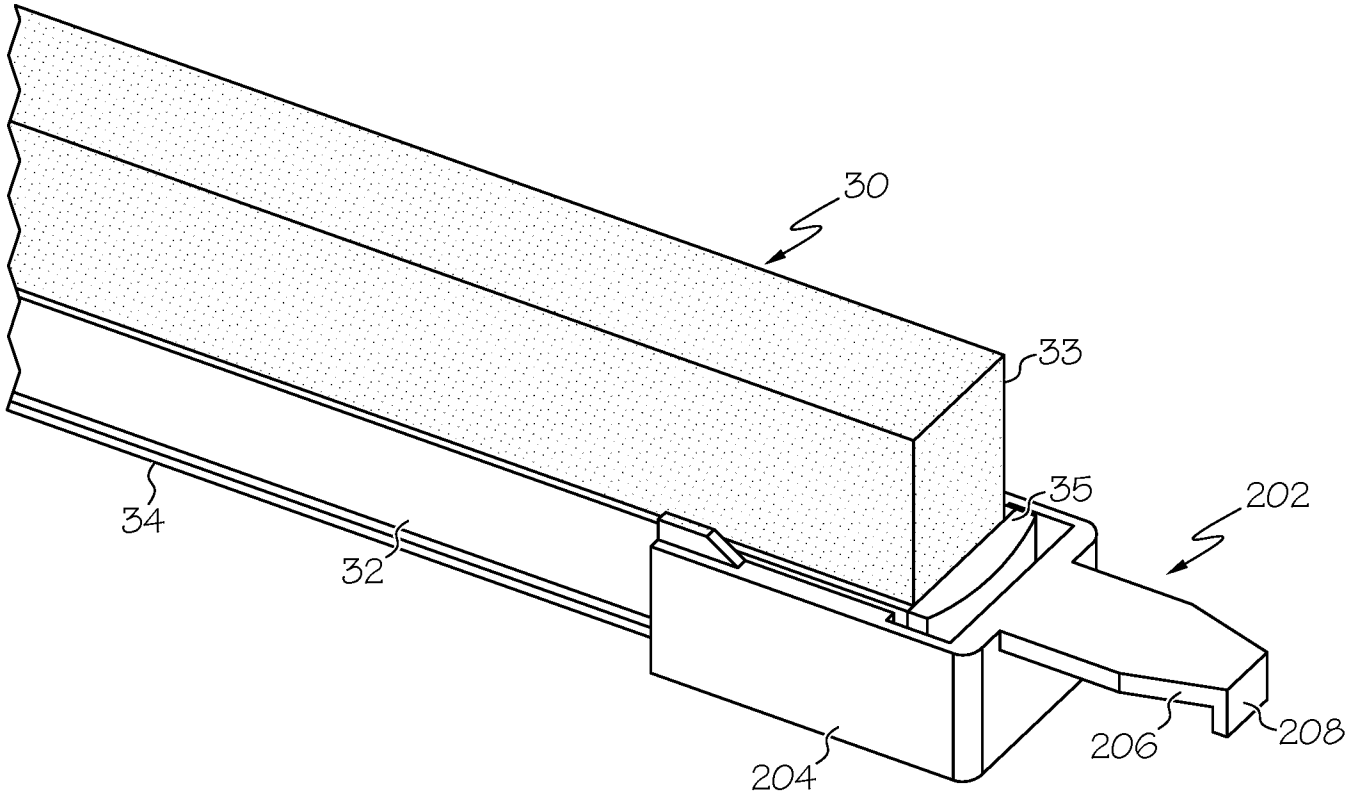
FIG. 3A-3B are perspective views of a second end connector in accordance with embodiments of the present inventive concepts.
Figure 3B:
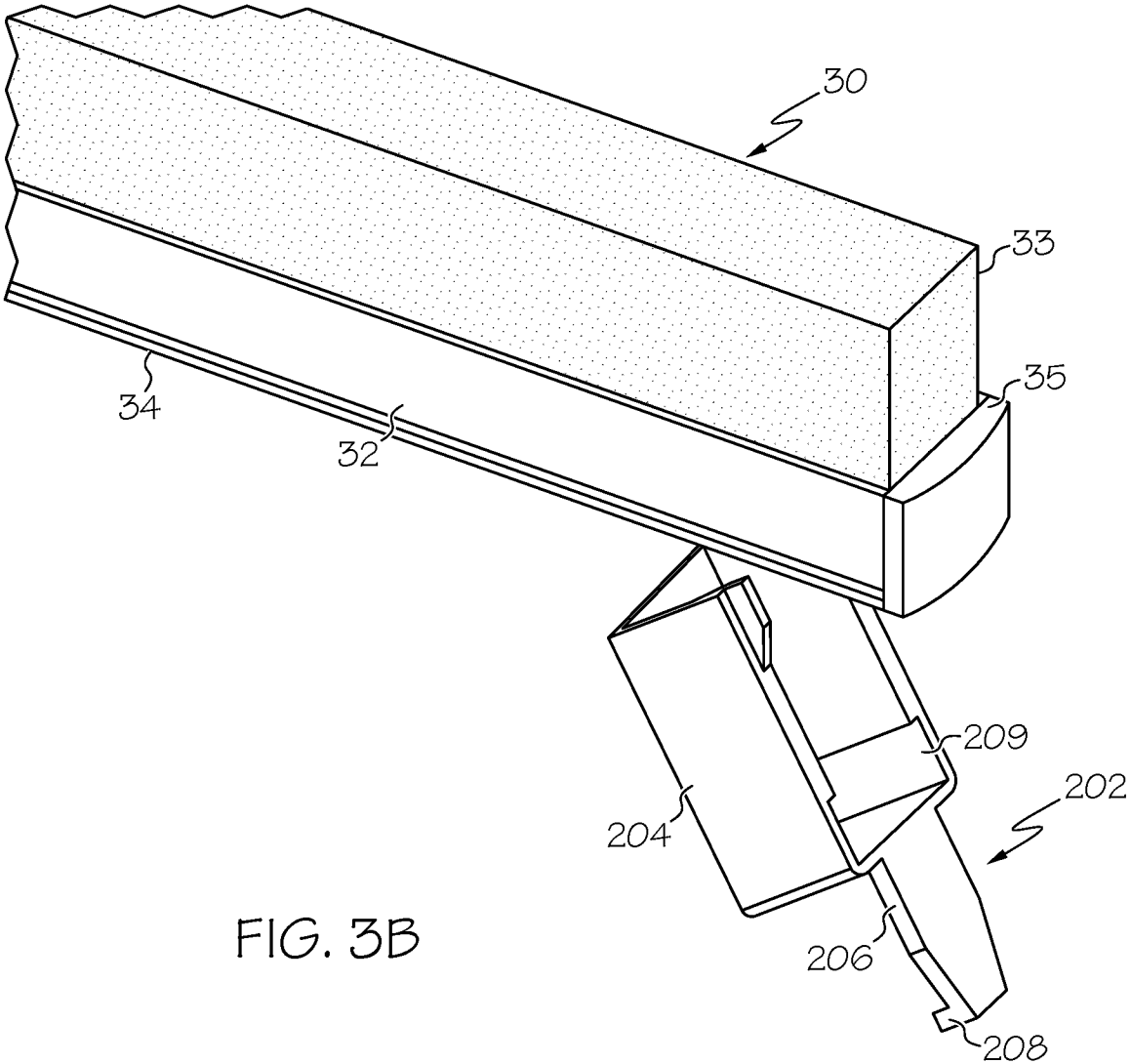

FIGS. 3A-3B are perspective views of a second end connector in accordance with embodiments of the present inventive concepts. A second end connector 102 includes a base portion 204 that pivotally snap-fits onto an end of the rail 32 of the head 30. An arm bridge 206 extends from the base portion 204, and a lip 208 is provided at an end of the arm bridge 206. The lips 208 extend in a vertical direction perpendicular to the horizontal direction of extension of the arm bridge 206.

Referring to FIG. 3B, in some embodiments, the second end connector 202 can have a pivotable snap-fit relationship with the rail 32 of the end of the head 30. A recess 209 in the second end connector 202 can be configured to receive an end cap 35 of the head rail 32.

Figure 4A:
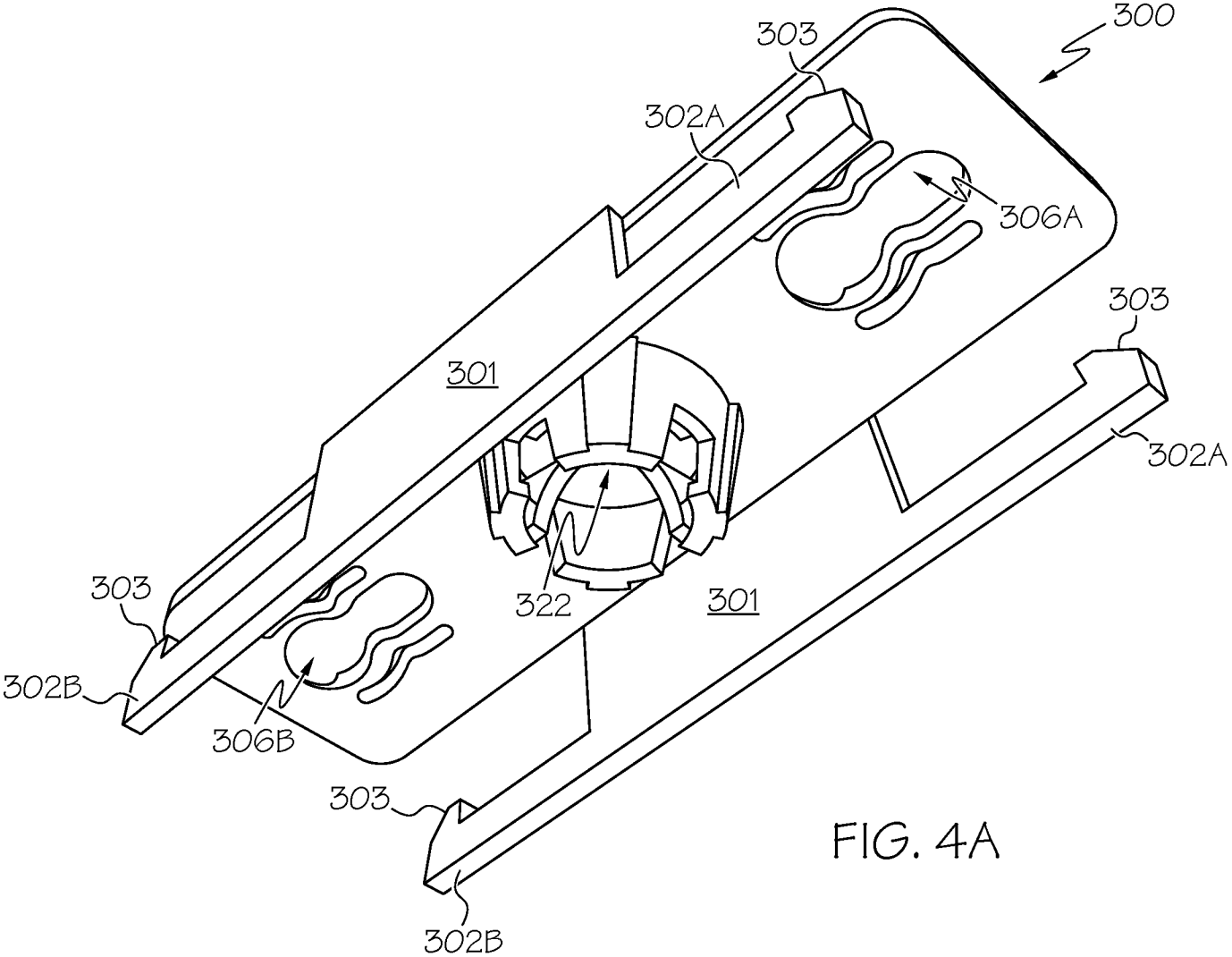
FIGS. 4A-4B are perspective and top views of a head in accordance with embodiments of the present inventive concepts.
Figure 4B:
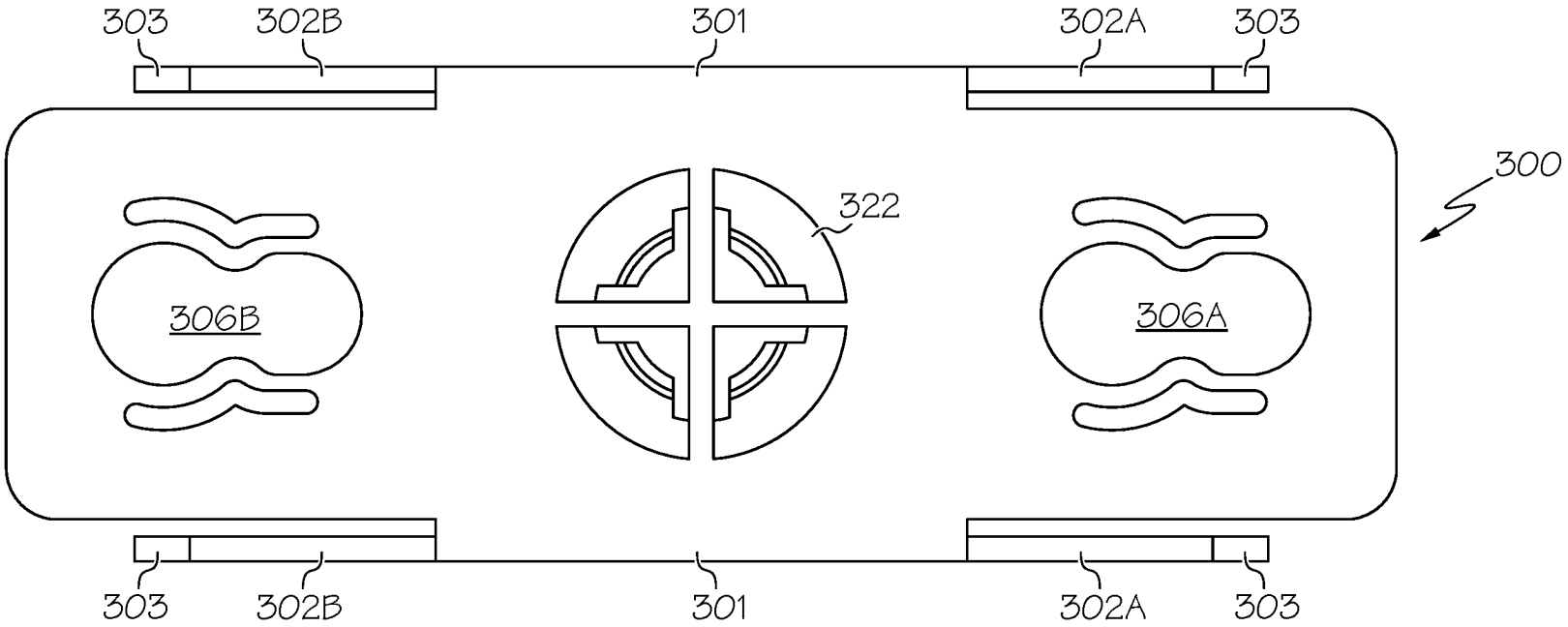
Figure 4C:
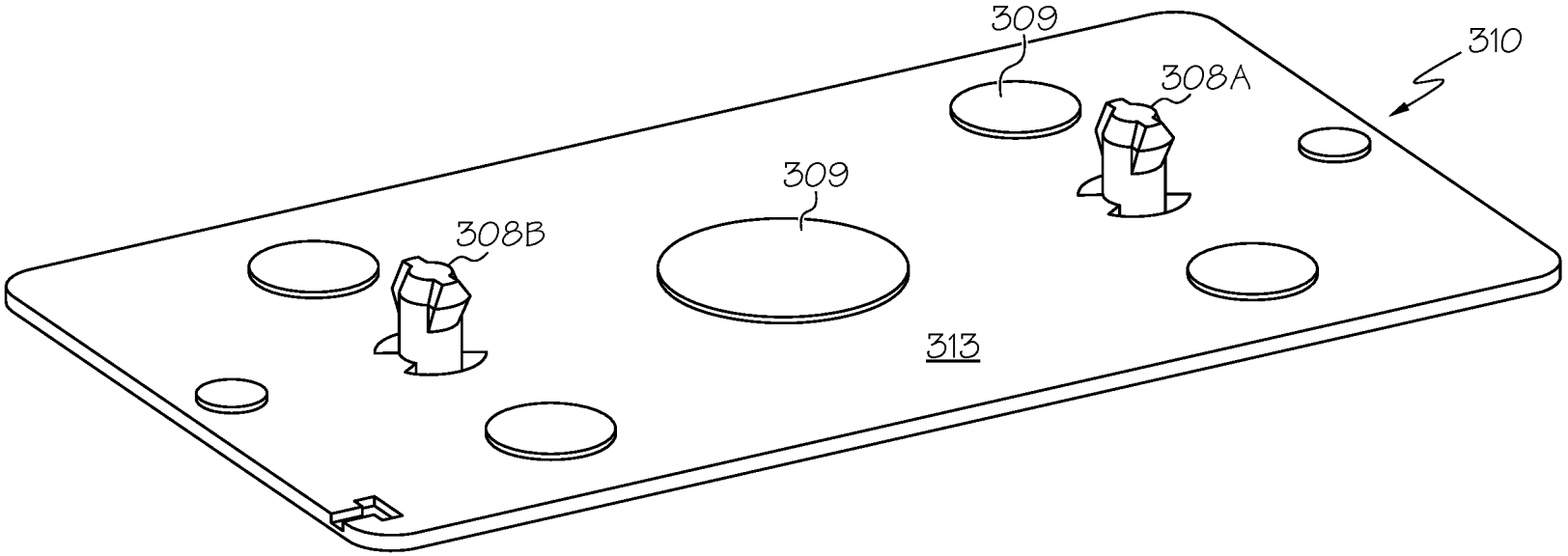
FIGS. 4C-4D are bottom and top perspective views of a clip in accordance with embodiments of the present inventive concepts.
Figure 4D:
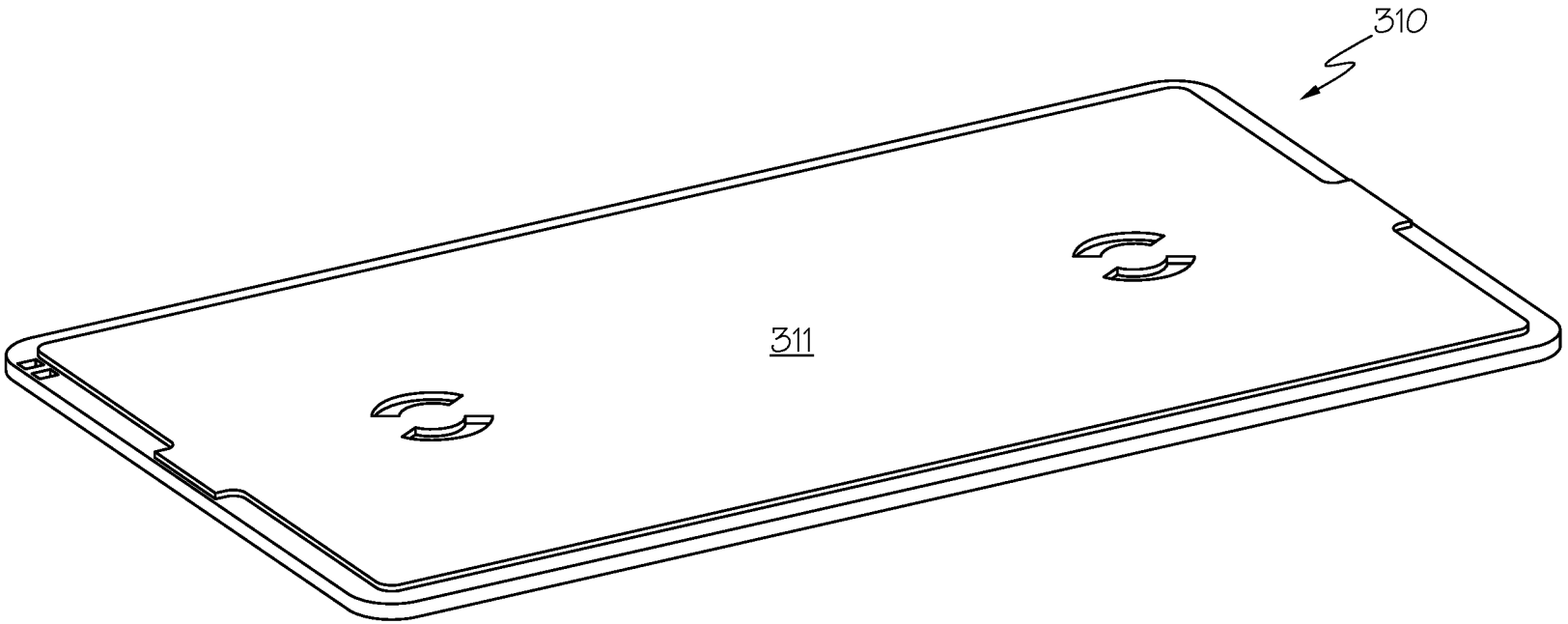
Figure 4E:
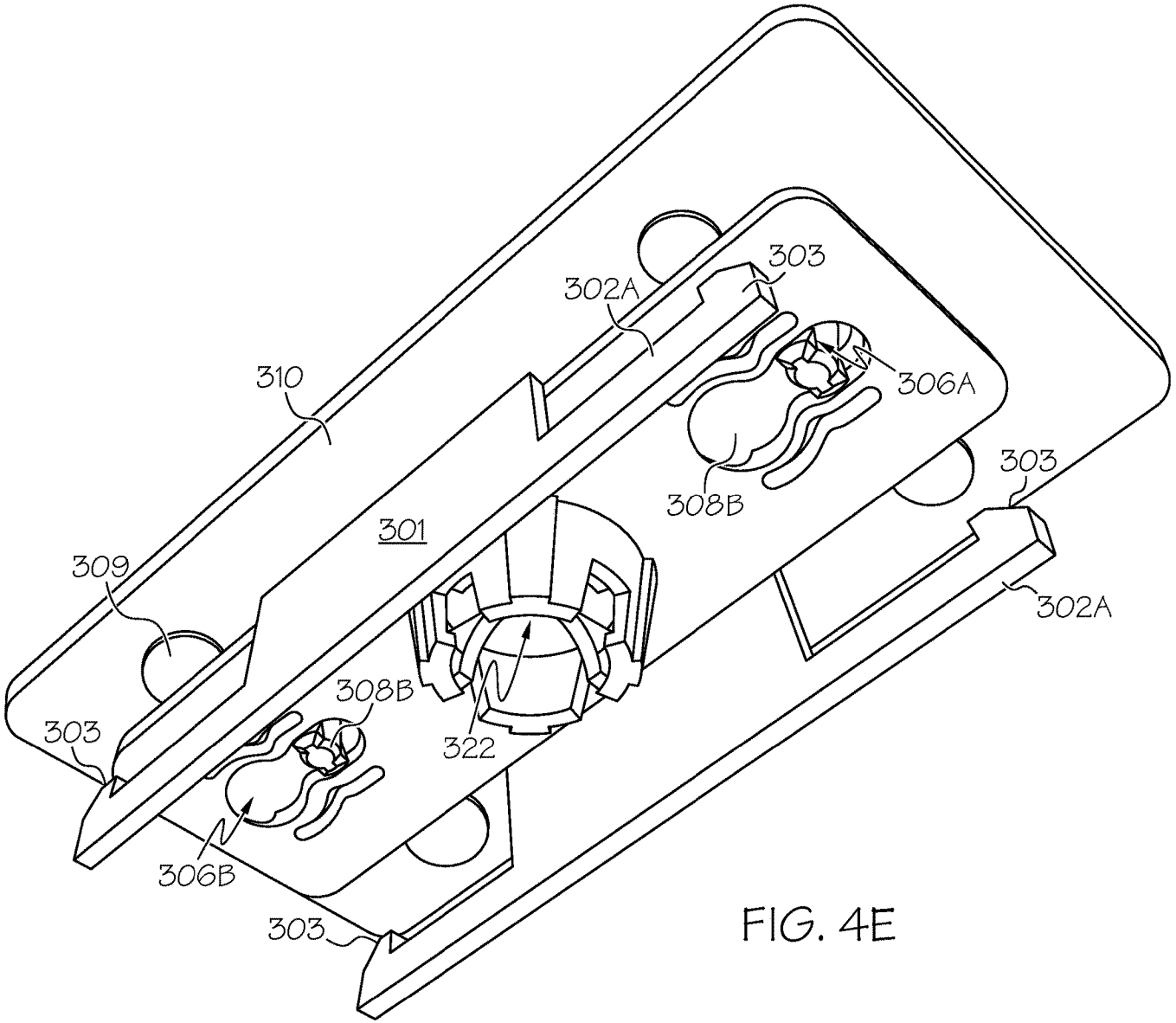
FIG. 4E is a perspective view of the head of FIGS. 4A-4B and the clip of FIGS. 4C-4D in accordance with embodiments of the present inventive concepts.

FIGS. 4A-4B are perspective views of a head end coupler in accordance with embodiments of the present inventive concepts. FIGS. 4C-4D are perspective views of a clip for the head end coupler in accordance with embodiments of the present inventive concepts. FIG. 4E is a perspective view of the head end coupler of FIGS. 4A-4B and the clip of FIGS. 4C-4D in accordance with embodiments of the present inventive concepts.

Referring to FIG. 4A, a head end coupler 300 includes a pole socket 322 for mating with a ball of a pole, as described herein, to thereby form a universal joint. Keyhole and slot openings 306A, 306B are provided for interfacing with pegs 308A, 308B provided on the mating clip 310 (see FIG. 4C). In this manner, the clip 310 and coupler 300 have a mating relationship for securing a dust partition curtain therebetween, as described for example in U.S. Pat. No. 7,658,219, incorporated herein by reference.

In some embodiments, base portions 301 extend in a vertical direction from a lower, center portion of the head end coupler 300. Coupling arms 302A, 302B extend in an outwardly horizontal direction from ends of the base portions 301. Distal ends of the coupling arms 302A, 302B include vertical lips 303, for example, as shown.

Referring to FIG. 4C, a clip 310 includes a generally planar base portion 313 and first and second pegs 308A, 308B that mate with the keyhole and slot openings 306A, 306B of the head end coupler 300. Optional compressive pads 309 are positioned for gripping the material of a dust containment curtain positioned between the clip 310 and coupler 300.

Referring to FIG. 4D, an upper portion of the clip can optionally include a pad 311, for example formed of a soft pliable surface that avoids damage to an abutting surface.

FIG. 4E is a perspective view illustrating a coupling of the clip 310 to the head end coupler 300. As illustrated, the horizontal area of the clip base 300 is slightly less than that of the clip 310; however, any of a number of possible arrangements for relative horizontal areas are equally applicable to the present inventive concepts.

Figure 5A:
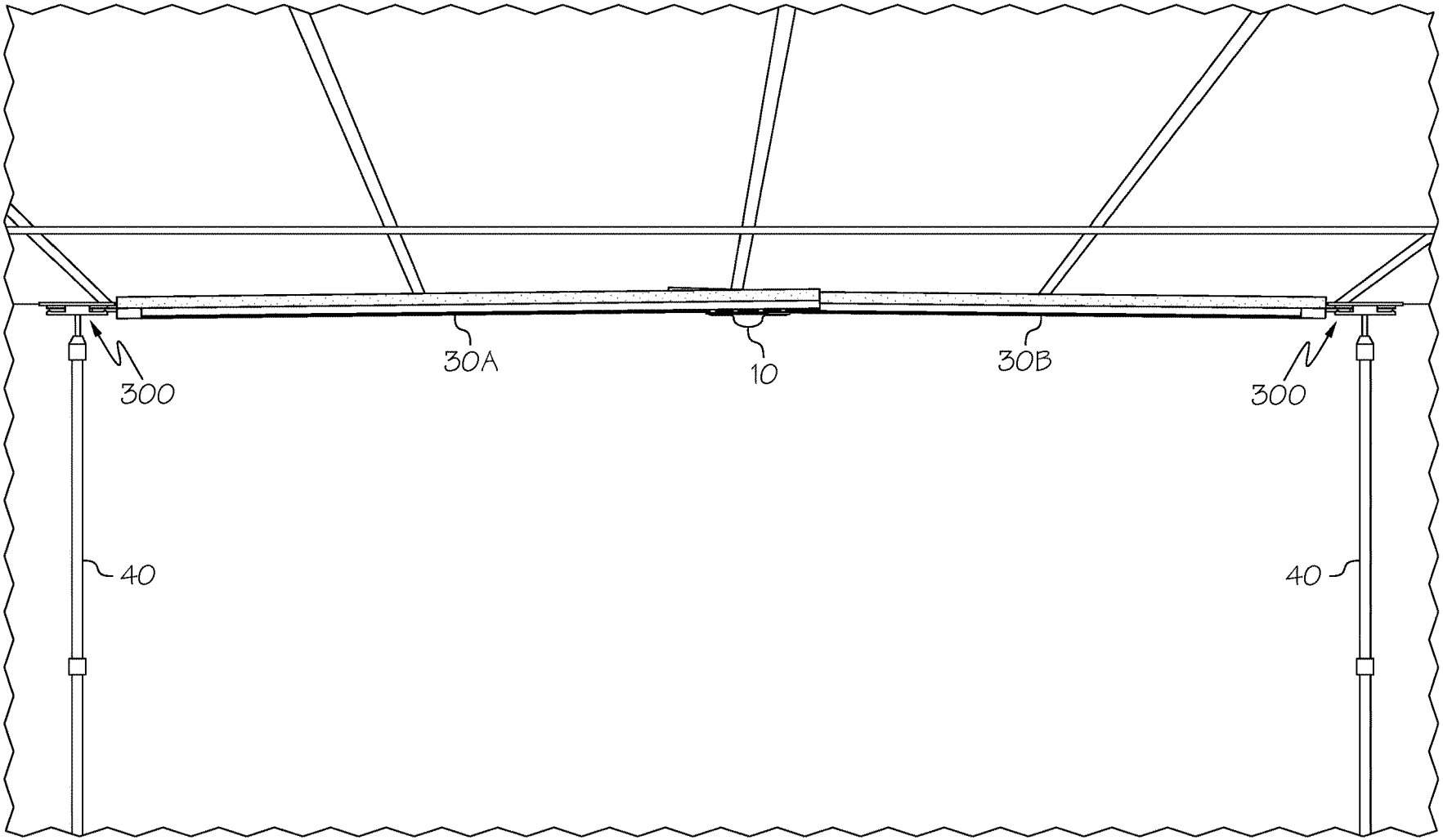
FIGS. 5A-5C are perspective views of an installed partition mount system in accordance with embodiments of the present inventive concepts.
Figure 5B:
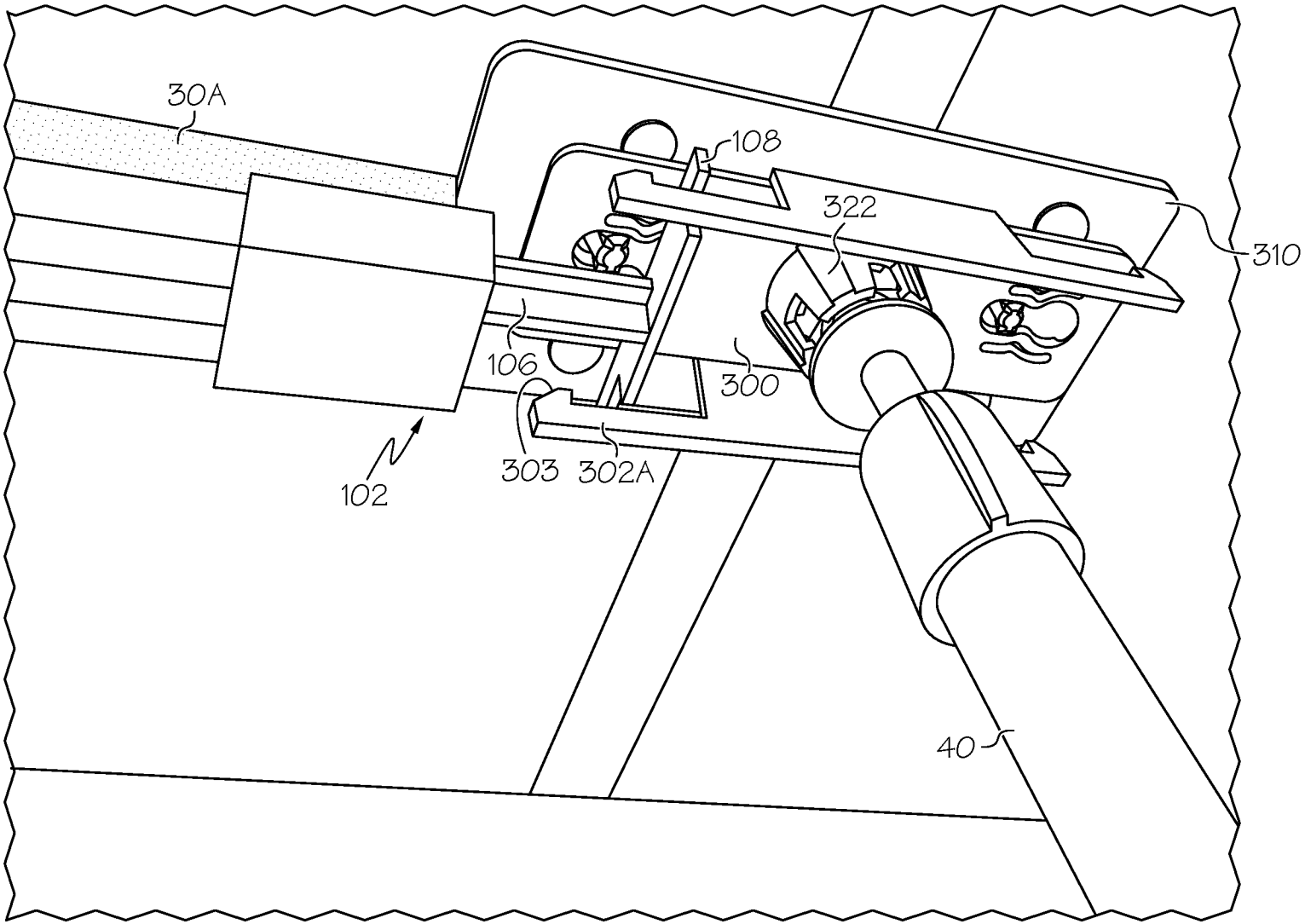
Figure 5C:
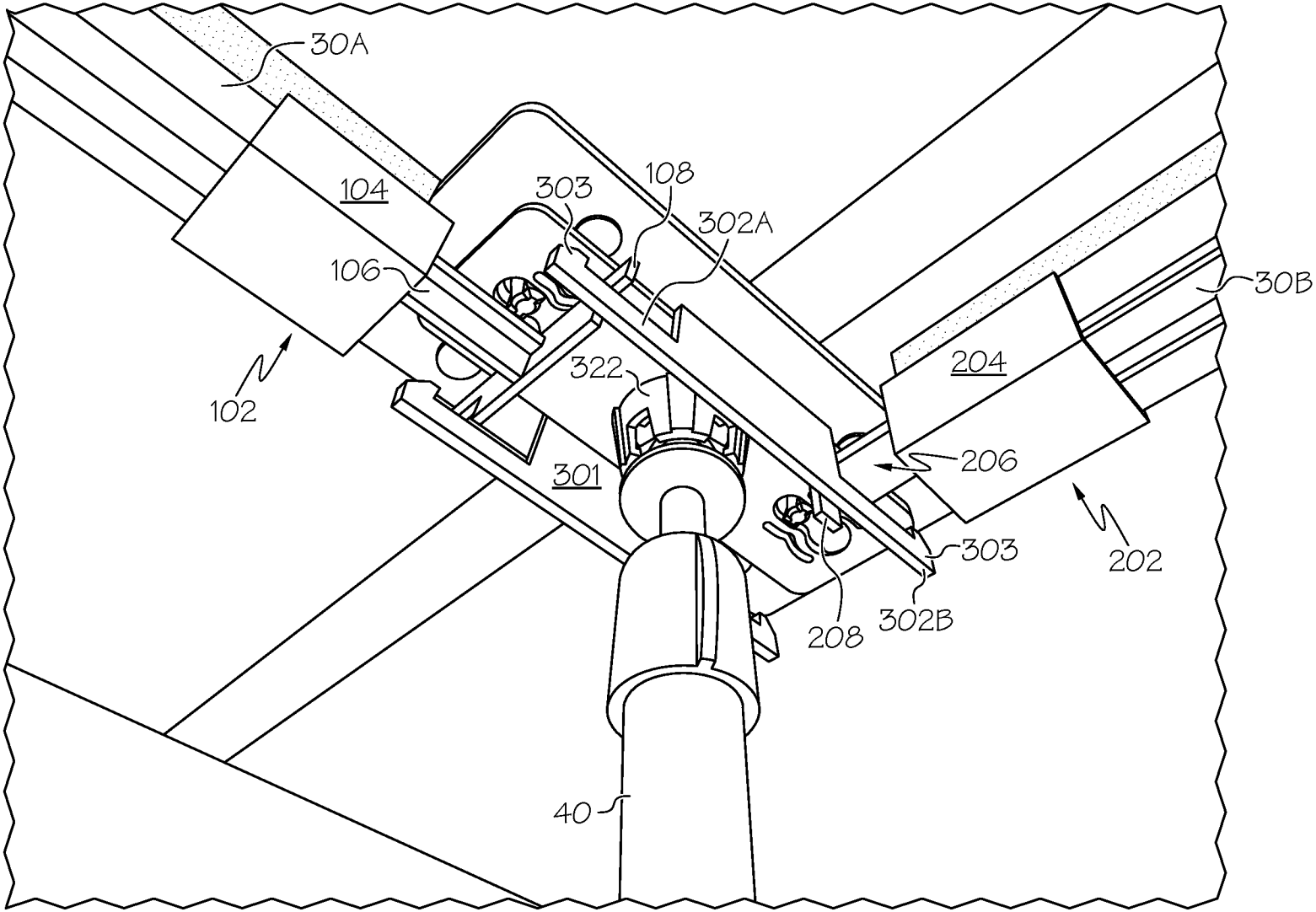

FIGS. 5A-5C are perspective views of a partition mount system in accordance with embodiments of the present inventive concepts. In the embodiment of FIG. 5A it can be seen that the first and second heads 30A, 30B are joined at a coupler 10 and supported by extension poles 40 at their opposite ends. Head end couplers 300 are provided to couple the poles 40 to the heads 30A, 30B at their ends. The illustrated arrangement is similar to the arrangement depicted in FIGS. 1I and 1I-1.

In the embodiment of FIG. 5B it can be seen that the head end coupler 300 is used to support an end of the first head 30A. A first end connector 102 of the type illustrated in FIG. 2 is coupled to an end of the first head 30A. It can be seen that the coupling arms 302A support the T-cross member 108 of the first end connector 102, while the vertical lips 303 prevent the T-cross member 108 from being inadvertently released from the head end coupler 300. The T-cross member 108 and coupling arms 302A are positioned and sized so as to allow for a certain degree of variability and play between the position of the head end coupler and heads 30A, 30B so that they do not need to be perfectly aligned at perpendicular horizontal and vertical angles when installed. As illustrated, the ceiling is a drop-ceiling type; however, the present inventive concepts are equally applicable to operation in connection with any type of ceiling or room surface.

In the embodiment of FIG. 5C it can be seen that the head end coupler 300 is used to support an end of the first head 30A and an end of a second head 30B, with the first and second heads 30A, 30B positioned at generally perpendicular angles relative to each other. In this example embodiment, the first head 30A is coupled using a first end connector 102 in a manner similar to that shown in FIG. 5B. A second head 30B is coupled using a second end connector 202 of the type illustrated in FIG. 3. It can be seen that the coupling arms 302B support the arm bridge 206 of the first end connector 102, while the lip 208 prevents the arm bridge 206 from being inadvertently released from the head end coupler 300. The arm bridge 206, lip 208 and coupling arms 302A, 302B, are positioned and sized so as to allow for a certain degree of variability and play between the position of the head end coupler and head 30B so that they do not need to be perfectly aligned at perpendicular horizontal and vertical angles when installed.

Figure 6A:
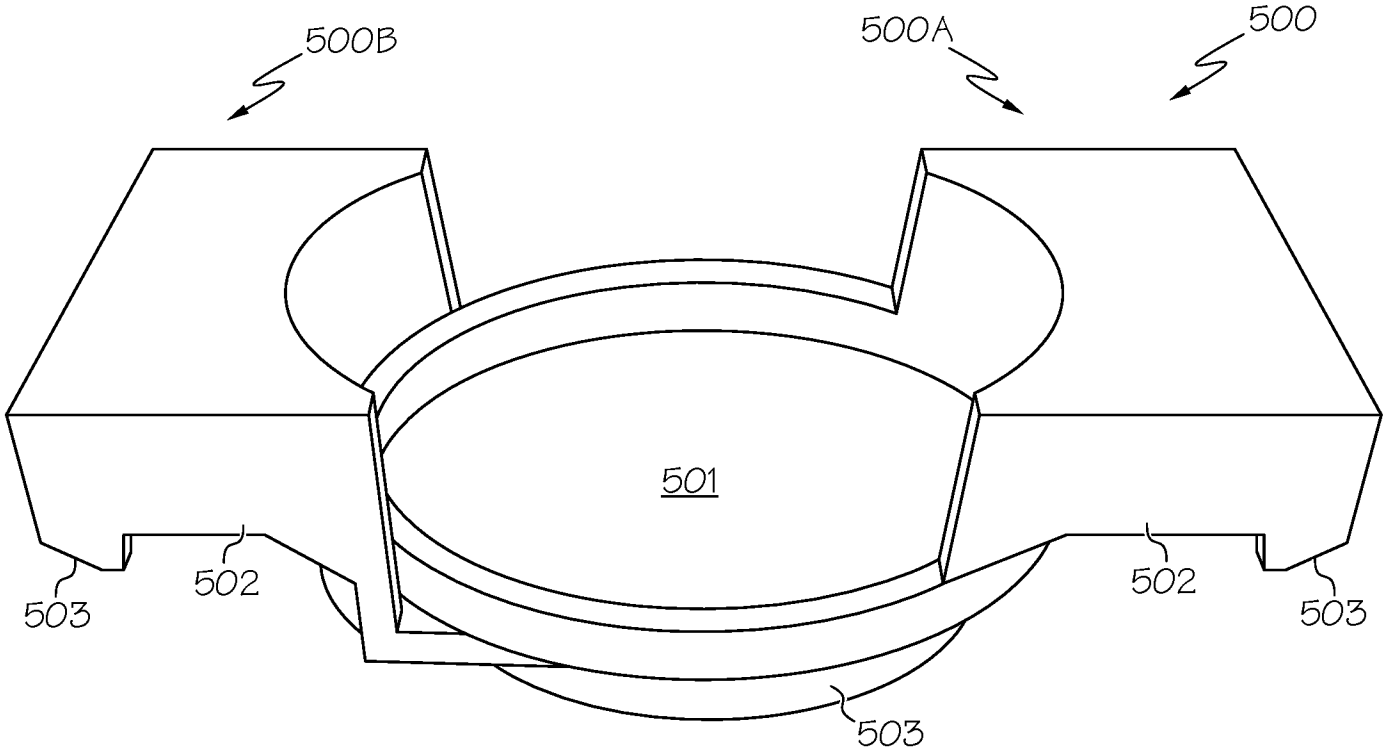
FIGS. 6A-6E are perspective views of a floor connector in accordance with embodiments of the present inventive concepts.
Figure 6C:
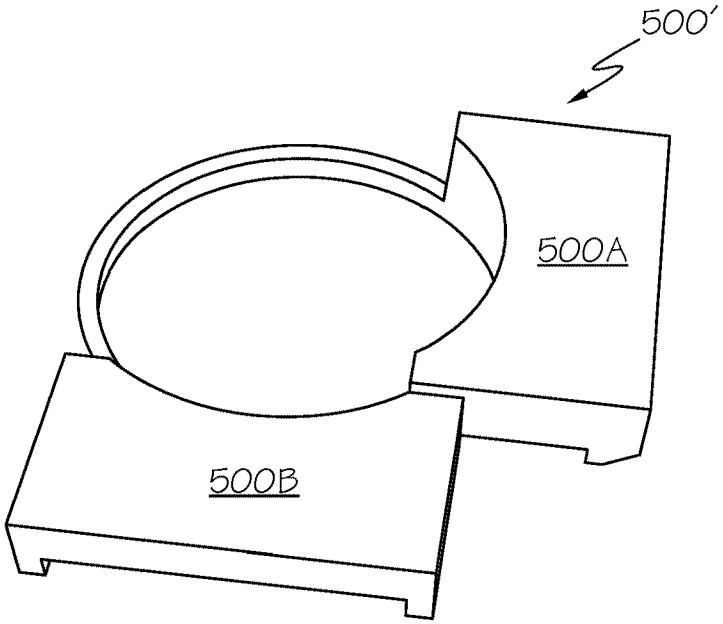
Figure 6B:
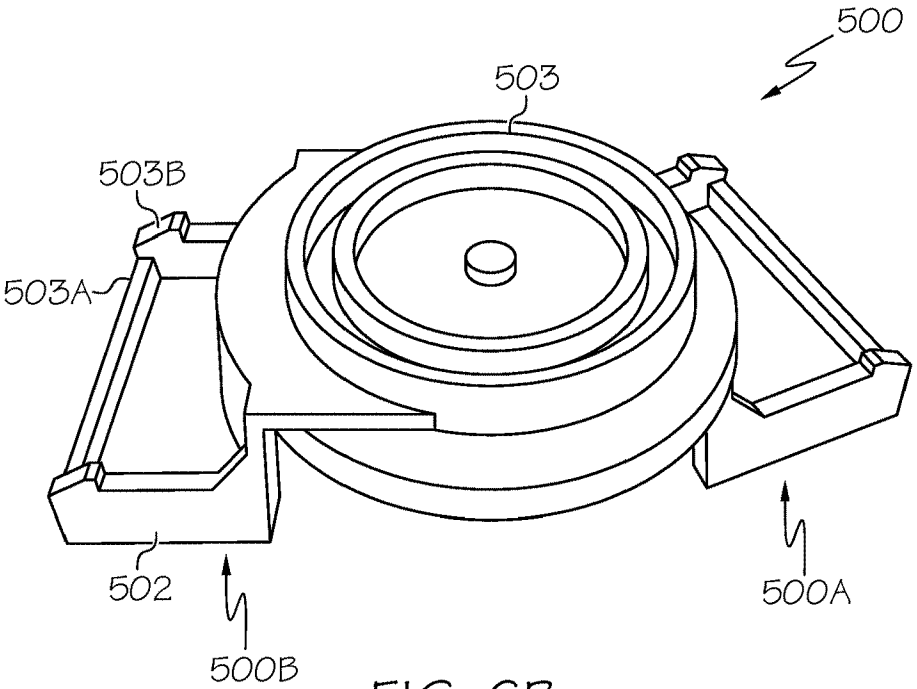
Figure 6D:
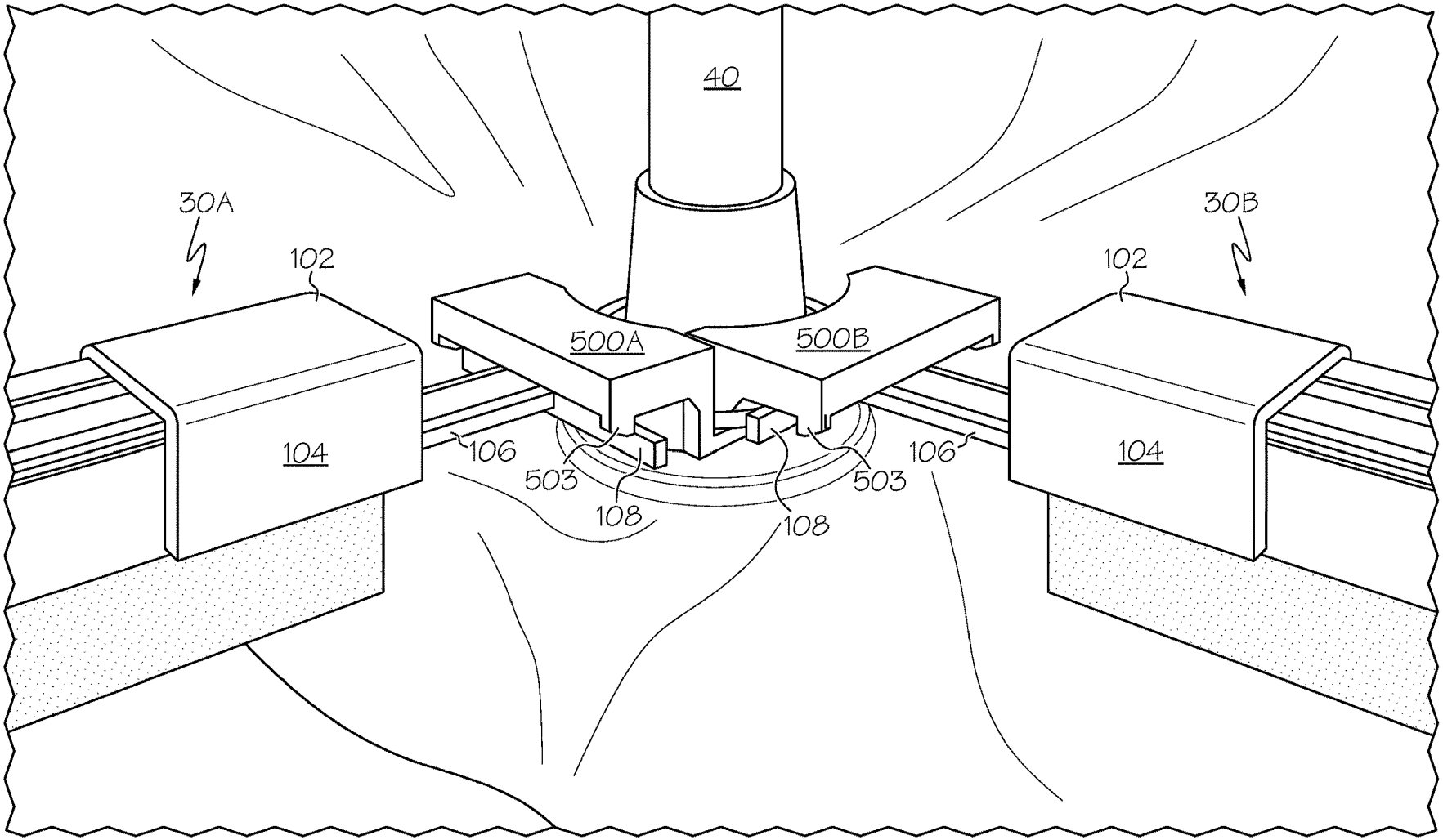
Figure 6E:
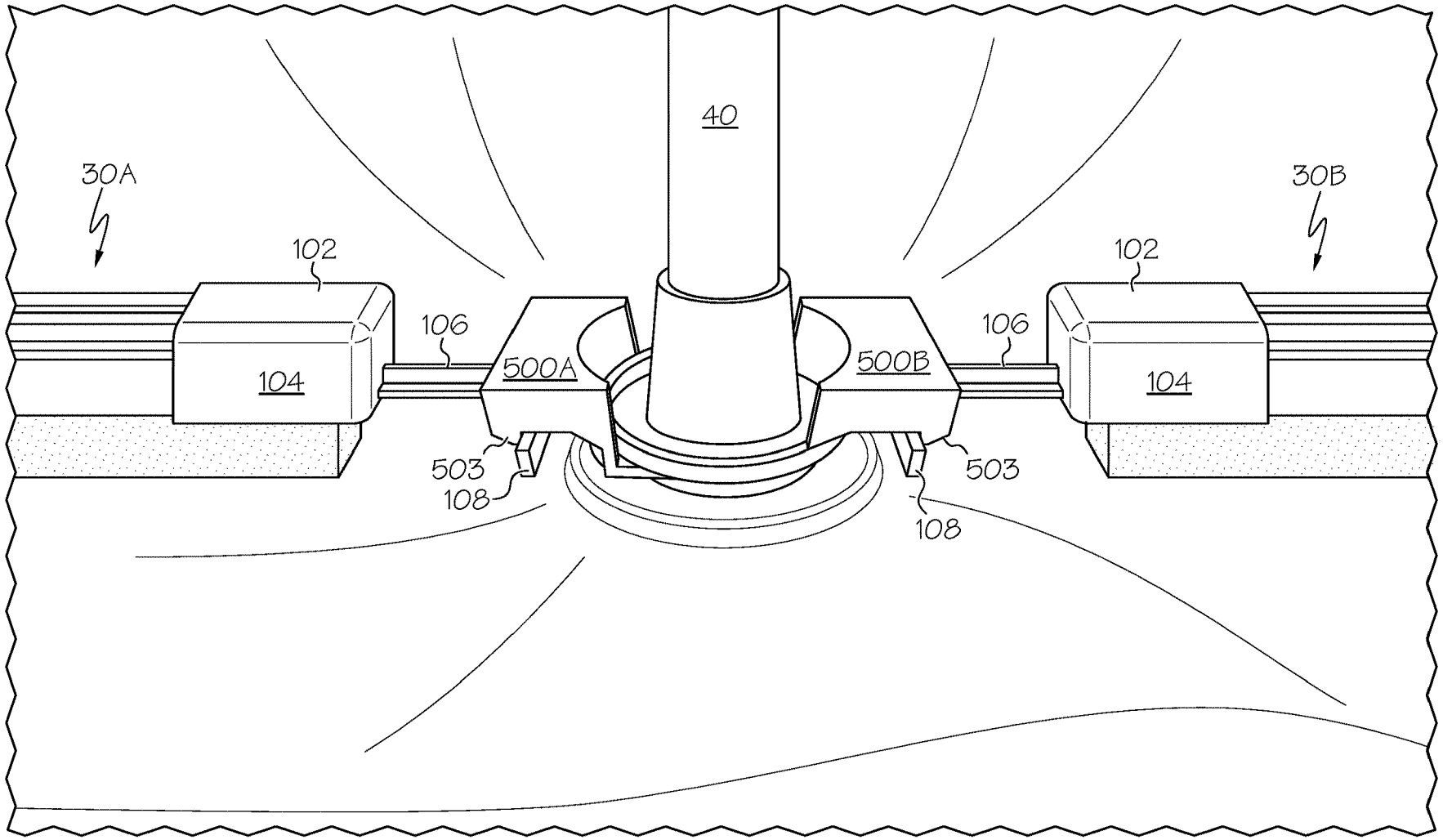

FIGS. 6A-6E are perspective views of a floor connector in accordance with embodiments of the present inventive concepts. The floor connector can include a hinged panel that allows for the coupling of one or more heads 30A, 30B with end connectors of the types disclosed herein attached thereto, as shown in FIG. 6D, 6E. In the present example embodiment the heads 30A, 30B can be employed to eliminate or mitigate air gaps present between the dust containment curtain and the floor of a room or building.

FIG. 6A is a perspective view of a floor connector 500. In some embodiments, the floor connector 500 includes a central base 501 and a compressible lower pad 503. In some embodiments, the lower pad comprises a soft, resilient material that avoids damage to an abutting surface such as floor of a room. First and second base portions 500A, 500B each swivel relative to each other and can include arm extensions 502 that extend in a horizontal direction, and vertical lip retainers 503 that extend from the arm extensions 502 in a downward vertical direction as shown. Referring to the underside view of FIG. 6B, it can be seen that the lip retainers 503 can include a first portion 503A for retaining a first end connector 102 coupled to an end portion of the floor connector 500 and a second portion 503B for retaining a second end connector 202 coupled to an side portion of the floor connector 500. Referring to FIG. 6C, it can be seen that the first and second base portions 500A, 500B have been swiveled relative to each other to be oriented to approximately ninety degrees relative to each other.

FIGS. 6D and 6E illustrate different configurations of an installation of the floor connector 500 positioned to connect end portions of the first and second heads 30A, 30B at different orientation angles. In each illustration, it can be seen that the lip retainers 503 operate to retain the T-cross member 108 to prevent the T-cross members 108 from being inadvertently released from the floor connector 500.

While the present inventive concepts have been particularly shown and described above with reference to example embodiments thereof, it will be understood by those of ordinary skill in the art, that various changes in form and detail can be made without departing from the spirit and scope of the present inventive concepts described and defined by the following claims.

What is claimed is:

1. A coupler comprising:

a first channel extending in a first horizontal direction;

a second channel extending in a second horizontal direction, the first and second channels horizontally offset in a third horizontal direction perpendicular to the first and second horizontal directions, wherein the first and second channels are pitched at an angle relative to each other in a vertical direction and the first and second channels are at least partially overlapped in the third horizontal direction, the first channel including first head-mounting features, the first head-mounting features constructed and arranged to retain a first elongated head to the coupler while permitting movement of the first elongated head relative to the coupler in the first horizontal direction; and the second channel including second head-mounting features, the second head-mounting features constructed and arranged to retain a second elongated head to the coupler while permitting movement of the second elongated head relative to the coupler in the second horizontal direction.

2. The coupler of claim 1, wherein the angle at which the first and second channels are pitched is a non-zero angle.

3. The coupler of claim 1 wherein the first and second head-mounting features each include at least one row of retention tabs.

4. The coupler of claim 3 wherein the at least one row of retention tabs of the first head-mounting features includes first and second rows of retention tabs spaced apart from each other and opposite each other in the first horizontal direction and the at least one row of retention tabs of the second head-mounting features includes third and fourth rows of retention tabs spaced apart from each other and opposite each other in the second horizontal direction.

5. The coupler of claim 3 wherein the at least one row of retention tabs of each of the first and second head-mounting features includes first and second rows of four retention tabs spaced apart from each other in the first horizontal direction and second horizontal direction, respectively, and spaced apart and opposite each other in the third horizontal direction.

6. The coupler of claim 3 wherein the retention tabs have an L-shaped cross section.

7. The coupler of claim 3 wherein the retention tabs of the first head-mounting features are below the retention tabs of the second head-mounting features in the vertical direction at a first portion of the coupler and wherein the retention tabs of the first head-mounting features are above the retention tabs of the second head-mounting features in the vertical direction at a second portion of the coupler.

8. The coupler of claim 3 further comprising the first elongated head having a length more than two-times a length of the first channel in the first horizontal direction and the second elongated head having a length more than two-times a length of the second channel in the second horizontal direction.

9. The coupler of claim 1 further comprising a locking mechanism that locks a position of the first elongated head in the first channel and locks a position of the second elongated head in the second channel.

10. The coupler of claim 9 wherein the locking mechanism comprises a body having first and second lobes positioned in the first and second channels, the body constructed and arranged to pivot so that the first and second lobes interfere with the first and second channels to prevent sliding of the first elongated head inserted in the first channel and to prevent sliding of the second elongated head in the second channel.

11. The coupler of claim 10 wherein the locking mechanism further comprises a tab to allow manual pivot of the lobes.

12. The coupler of claim 1 further comprising a socket constructed and arranged to receive a ball of a support pole.

13. The coupler of claim 12 wherein the socket forms a universal joint with the ball of the support pole to permit pivot of the coupler relative to the support pole.

14. The coupler of claim 12 further comprising first and second neck retainers spaced apart from each other and parallel to each other on opposite sides of the socket to limit pivot of the coupler relative to the pole to one degree of freedom about the second horizontal direction, and to prevent pivot of the coupler relative to the pole about the second horizontal direction.

15. The coupler of claim 1 wherein the angle at which the first and second channels are pitched is between about 0.5 degrees and 10 degrees.

16. The coupler of claim 1 wherein the angle at which the first and second channels are pitched is about 2.0 degrees.

17. The coupler of claim 1 wherein the first and second head-mounting features permit sliding movement of the first elongated head and second elongated head respectively relative to the coupler in the first horizontal direction.

18. The coupler of claim 1 wherein the first and second head-mounting features permit sliding movement of the first elongated head and second elongated head respectively beyond both a first end and a second end of each channel.

19. A coupler comprising:

a first channel extending in a first horizontal direction;

a second channel extending in a second horizontal direction, the first and second channels horizontally offset in a third horizontal direction perpendicular to the first and second horizontal directions, wherein the first and second channels are pitched at an angle relative to each other in a vertical direction, the first channel including first head-mounting features, the first head-mounting features constructed and arranged to retain a first elongated head to the coupler while permitting movement of the first elongated head relative to the coupler in the first horizontal direction; and the second channel including second head-mounting features, the second head-mounting features constructed and arranged to retain a second elongated head to the coupler while permitting movement of the second elongated head relative to the coupler in the second horizontal direction, wherein the first and second head-mounting features each include at least one row of retention tabs, and wherein the retention tabs of the first head-mounting features are below the retention tabs of the second head-mounting features in the vertical direction at a first portion of the coupler and wherein the retention tabs of the first head-mounting features are above the retention tabs of the second head-mounting features in the vertical direction at a second portion of the coupler.

* * * * *